US011630417B2

(12) United States Patent
Nakajima

(10) Patent No.: US 11,630,417 B2
(45) Date of Patent: Apr. 18, 2023

(54) IMAGE FORMING APPARATUS INCLUDING SHEET MEMBER CONTAINING FLOW OF EXHAUST AIR

(71) Applicant: CANON KABUSHIKI KAISHA, Tokyo (JP)

(72) Inventor: Takao Nakajima, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/569,166

(22) Filed: Jan. 5, 2022

(65) Prior Publication Data

US 2022/0214636 A1 Jul. 7, 2022

(30) Foreign Application Priority Data

Jan. 6, 2021 (JP) ..... JP2021-000703

(51) Int. Cl.

| | |
|---|---|
| ***G03G 21/00*** | (2006.01) |
| ***G03G 21/20*** | (2006.01) |
| ***G03G 15/16*** | (2006.01) |
| *G03G 15/20* | (2006.01) |

(52) U.S. Cl.

CPC ..... *G03G 21/206* (2013.01); *G03G 15/1605* (2013.01); *G03G 15/2017* (2013.01); *G03G 2221/1645* (2013.01)

(58) Field of Classification Search

CPC ..... G03G 15/161; G03G 15/1605; G03G 15/0189; G03G 21/206; G03G 2215/0122; G03G 2215/0125; G03G 2221/1645

USPC ..... 399/92, 302, 303

See application file for complete search history.

(56) References Cited

U.S. PATENT DOCUMENTS

| | | | | |
|---|---|---|---|---|
| 9,268,269 | B2 | 2/2016 | Sekiya | |
| 9,411,275 | B2 | 8/2016 | Sugiyama et al. | |
| 9,625,877 | B2 | 4/2017 | Yamashita et al. | |
| 10,671,020 | B2 * | 6/2020 | Yoshioka | G03G 21/206 |
| 2014/0376950 | A1 * | 12/2014 | Hara | G03G 21/206 399/92 |

FOREIGN PATENT DOCUMENTS

| | | | |
|---|---|---|---|
| JP | 2006098904 A | * | 4/2006 |
| JP | 2012-141645 A | | 7/2012 |
| JP | 2014-142606 A | | 8/2014 |
| JP | 2015-158600 A | | 9/2015 |
| JP | 2016-173490 A | | 9/2016 |

* cited by examiner

*Primary Examiner* — Robert B Beatty
(74) *Attorney, Agent, or Firm* — Venable LLP

(57) ABSTRACT

An image forming apparatus includes an image forming portion, a transfer belt, a secondary transfer portion, a cleaning member contacting a surface of the transfer belt for cleaning the surface of the transfer belt, a fixing device, an exhausting device, a duct portion and a sheet member. The sheet member is provided on the exhausting device so as to project toward the transfer belt from the exhausting device, the sheet member being opposed to transfer belt and separated by a predetermined space downstream of the transfer portion and upstream of the cleaning member with respect to a rotational direction of the transfer belt, and being configured to prevent air flow between the exhausting device and the transfer belt from flowing downstream with respect to the rotational direction.

8 Claims, 11 Drawing Sheets

(a)

(b)

IMAGE FORMING APPARATUS INCLUDING SHEET MEMBER CONTAINING FLOW OF EXHAUST AIR

FIELD OF THE INVENTION AND RELATED ART

The present invention relates to an image forming apparatus, such as a copying machine, a printer, a fax machine, or a multi-function machine which has multiple functions of these devices.

Conventionally, as an image forming apparatus, a constitution of an intermediary transfer method, where a toner image formed on a photosensitive drum as an image bearing member is transferred to an intermediary transfer belt in a primary transfer portion and then transferred from the intermediary transfer belt to a recording material in a secondary transfer portion, is known. The toner image transferred from the intermediary transfer belt to the recording material is fixed to the recording material by pressurizing and heating it in a fixing device. Further, after the toner image is transferred from the intermediary transfer belt to the recording material, a surface of the intermediary transfer belt is cleaned by a cleaning member such as a cleaning blade.

The fixing device is arranged downstream with respect to a feeding direction of the recording material in the secondary transfer portion in order to fix the toner image on the recording material which has passed through the secondary transfer portion. For example, a constitution in which the fixing device is arranged above the secondary transfer portion is described in Japanese Laid-Open Patent Application 2015-158600.

Hitherto, there have been some cases where a moisture in the recording material evaporates while the recording material is passing through the fixing device and the evaporated moisture reaches the cleaning member which cleans the intermediary transfer belt. The evaporated moisture reaches the cleaning member by moving with an airflow generated by a rotation of the intermediary transfer belt, or by being attached to the intermediary transfer belt itself.

In this case, an abutting portion (cleaning nip portion) between the intermediary transfer belt and the cleaning member is lubricated by paper dust and transfer residual toner attached to a passing portion, which the recording material has passed through, of the surface of the intermediary transfer belt, in a case that the recording material passing through the secondary transfer portion is small size. On the other hand, moisture accumulates in a non-passing portion, which the recording material has not passed through, of the surface of the intermediary transfer belt, and frictional resistance increases in the cleaning nip portion.

In a case that the non-passing portion of the recording material on the intermediary transfer belt continues to receive frictional resistance, a transfer image quality may deteriorate in a portion affected by plastic deformation when the recording material which is larger than one with small size is passed through the secondary transfer portion while the intermediary transfer belt is plastically deformed.

SUMMARY OF THE INVENTION

An object of the present invention is to provide a constitution which can suppress a deterioration of a transfer image quality.

The image forming apparatus of the present invention can include an image forming portion configured to form a toner image, a transfer belt rotatably provided and onto which the toner image is transferred, a secondary transfer portion configured to transfer the toner image onto a recording material from the transfer belt, a cleaning member contacting a surface of the transfer belt and configured to clean the surface of the transfer belt, a fixing device provided above the secondary transfer portion in a vertical direction and configured to fix the toner transferred onto the recording material on the recording material, an exhausting device provided with a suction port disposed above the transfer belt to oppose the transfer belt and opening toward between the secondary transfer portion and the fixing device, and a duct portion configured to exhaust air sucked from the suction port, and a sheet member provided on the exhausting device so as to project toward the transfer belt from the exhausting device, the sheet member being opposed, with a predetermined space therebetween, to the surface of the transfer belt downstream of the transfer portion and upstream of the cleaning member with respect to a rotational direction of the transfer belt, and being configured to prevent air flow between the exhausting device and the transfer belt from flowing downstream with respect to the rotational direction of the transfer belt.

Further features of the present invention will become apparent from the following description of exemplary embodiments (with reference to the attached drawings).

Figure 2:
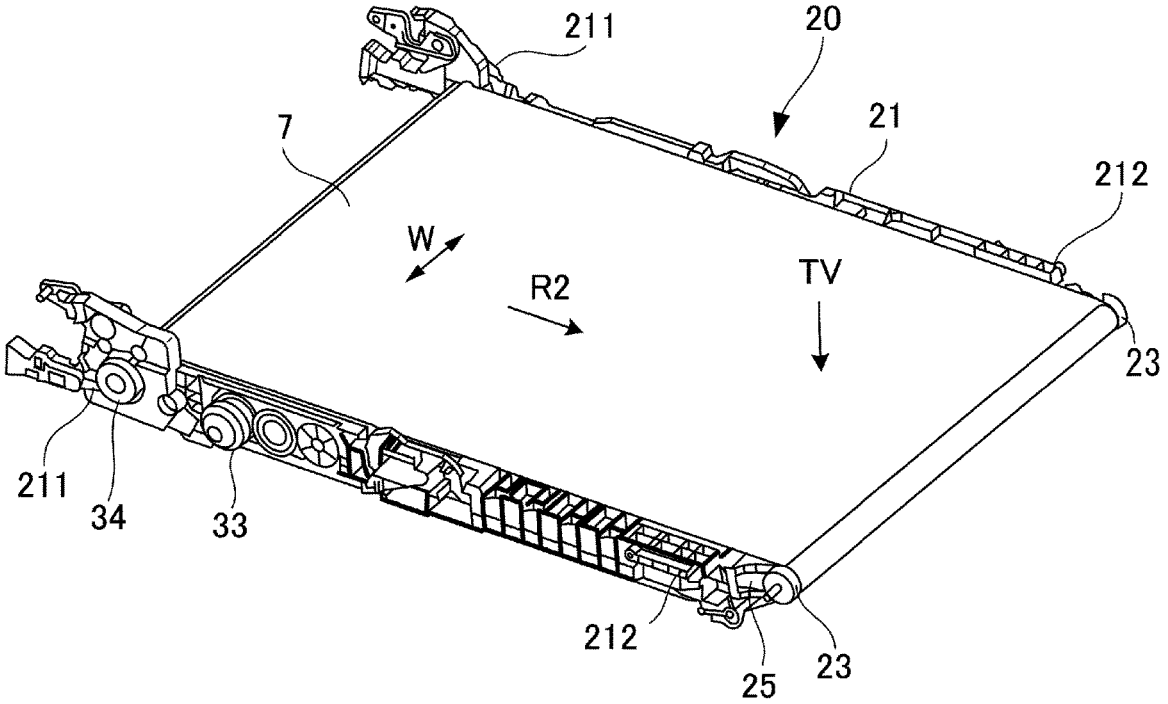
Figure 2:
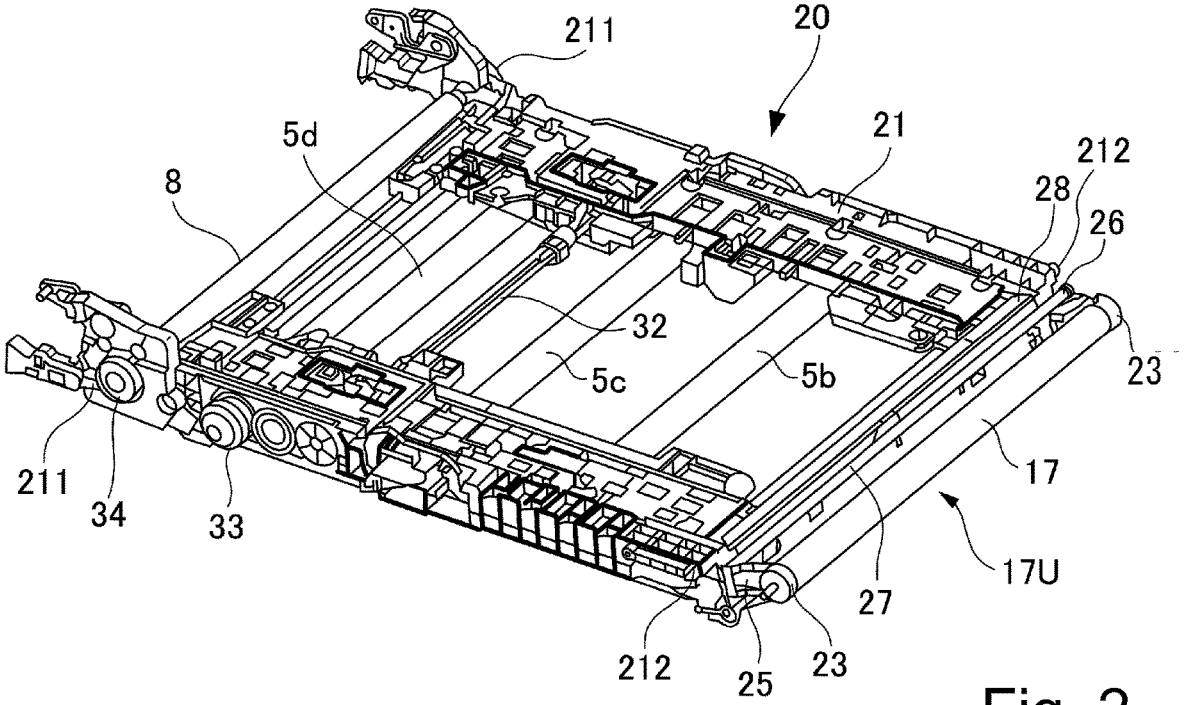

Part (a) of FIG. 2 is a perspective view of an intermediary transfer unit and part (b) of FIG. 2 is a perspective view of the intermediary transfer unit while an intermediary transfer belt is removed.

Figure 3:
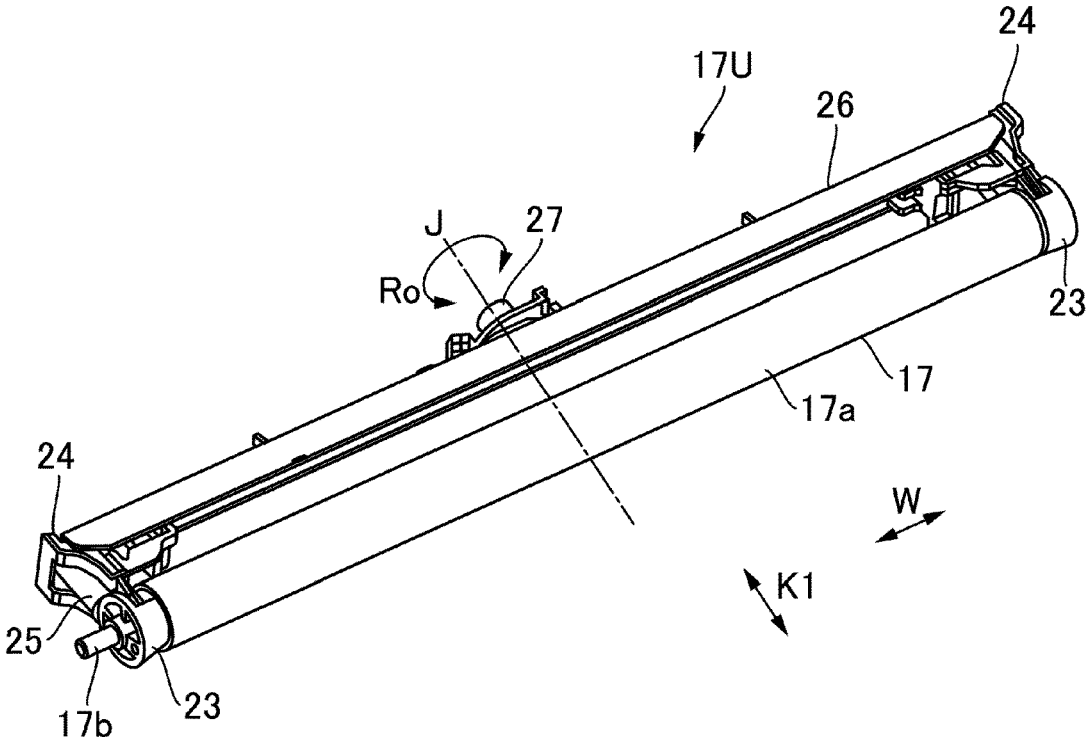

FIG. 3 is a perspective view of a belt self-alignment mechanism.

Figure 4:
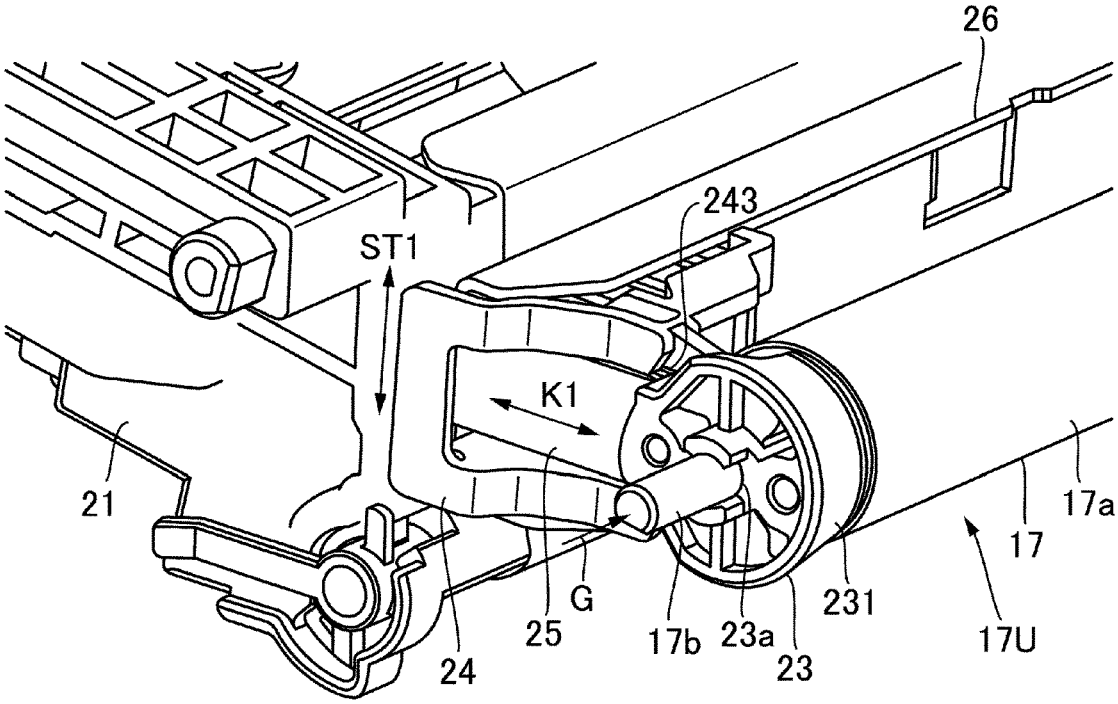

FIG. 4 is an enlarged perspective view of a belt self-alignment mechanism.

Figure 5:
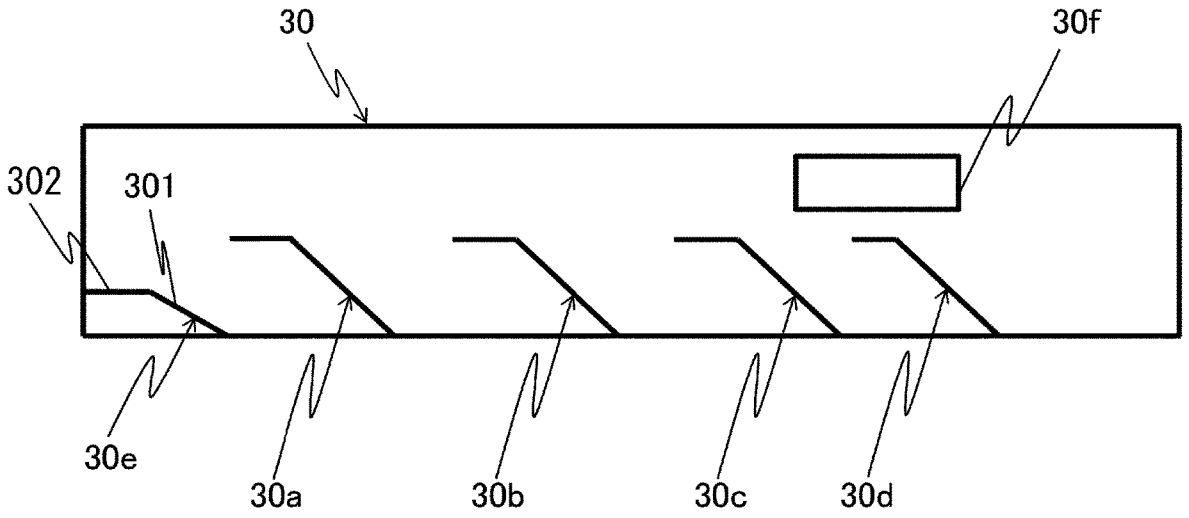

FIG. 5 is a schematic view of a spacing slider according to the embodiment.

Figure 6:
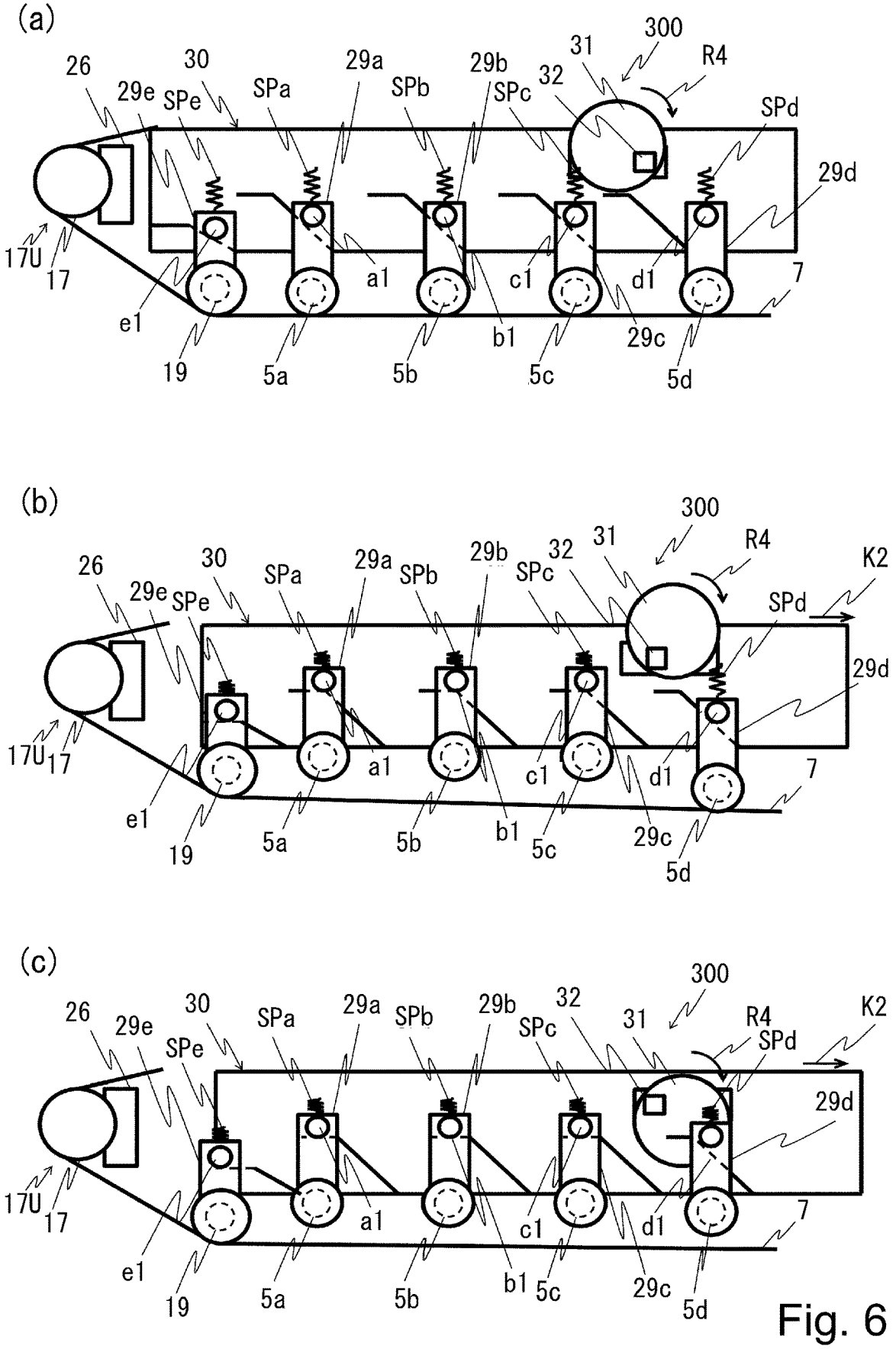

Part (a) of FIG. 6 is a schematic view of a state of a spacing mechanism in color mode in the intermediary transfer unit, part (b) of FIG. 6 is a schematic view of a state of the spacing mechanism in monochrome mode in the intermediary transfer unit, and part (c) of FIG. 6 is a schematic view of a state of the spacing mechanism in full spacing mode in the intermediary transfer unit.

Figure 7:
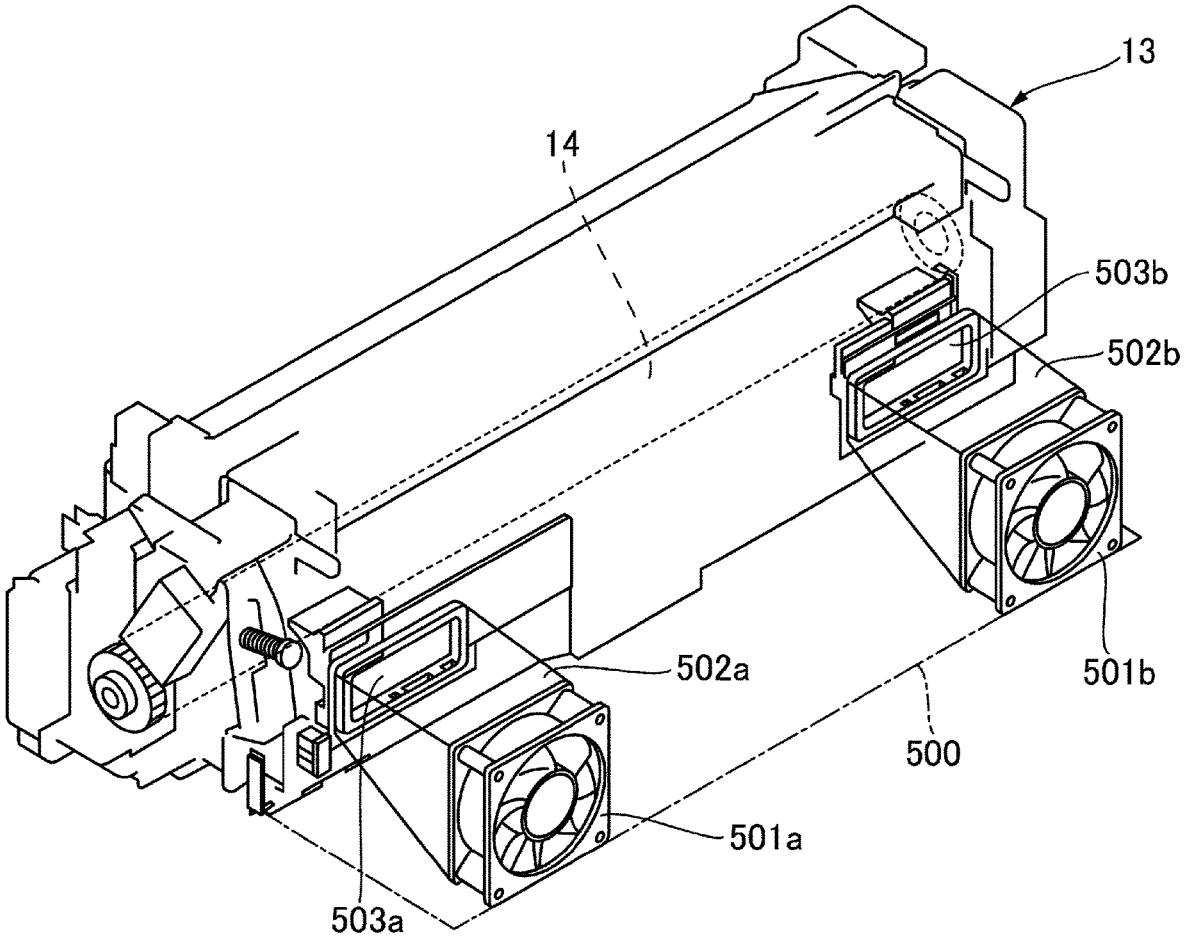

FIG. 7 is a perspective view of a fixing device and a blower device according to the embodiment.

Figure 8:
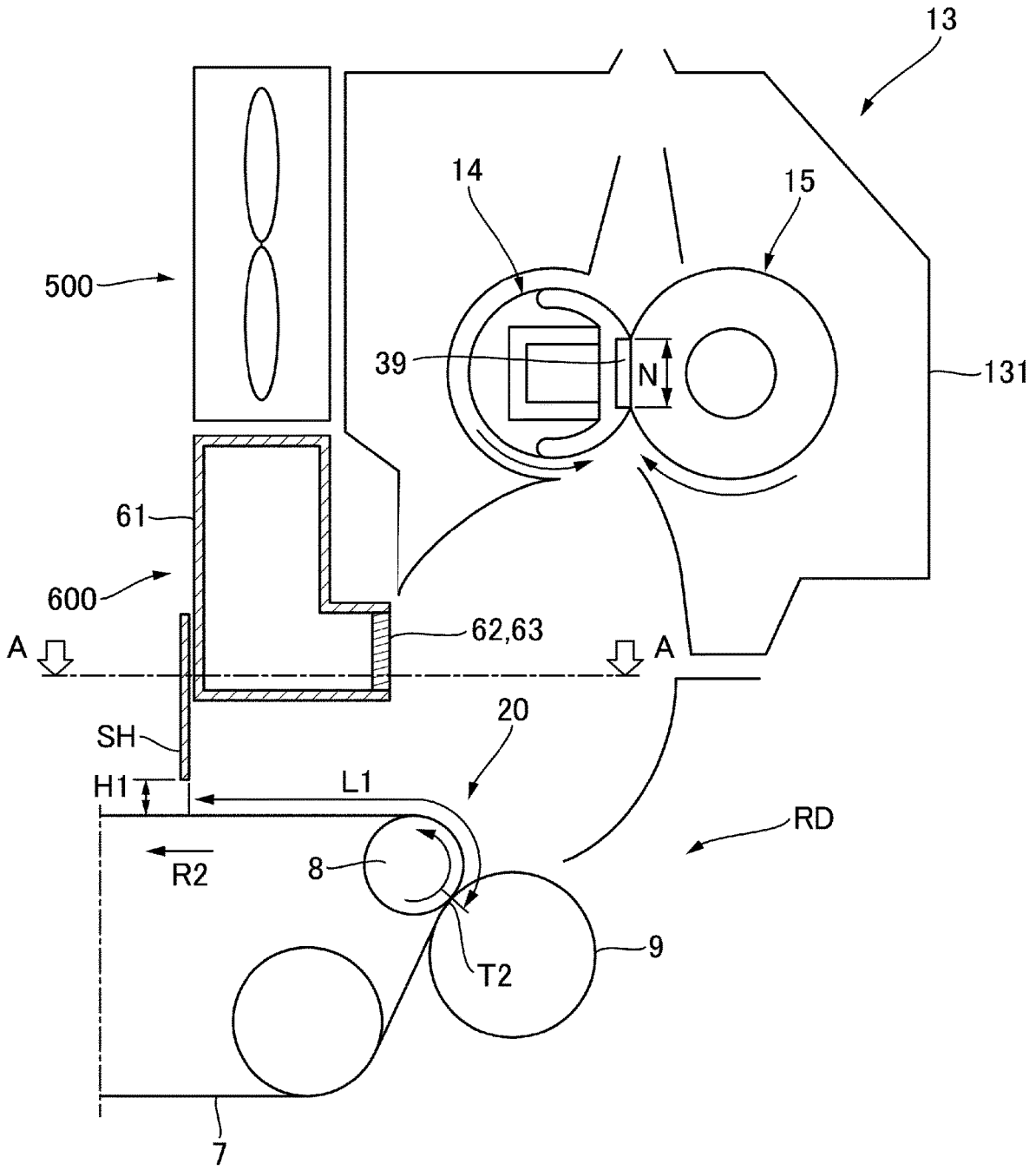

FIG. 8 is an enlarged sectional view of a secondary transfer portion and a peripheral portion of a fixing device according to the embodiment.

Figure 9:
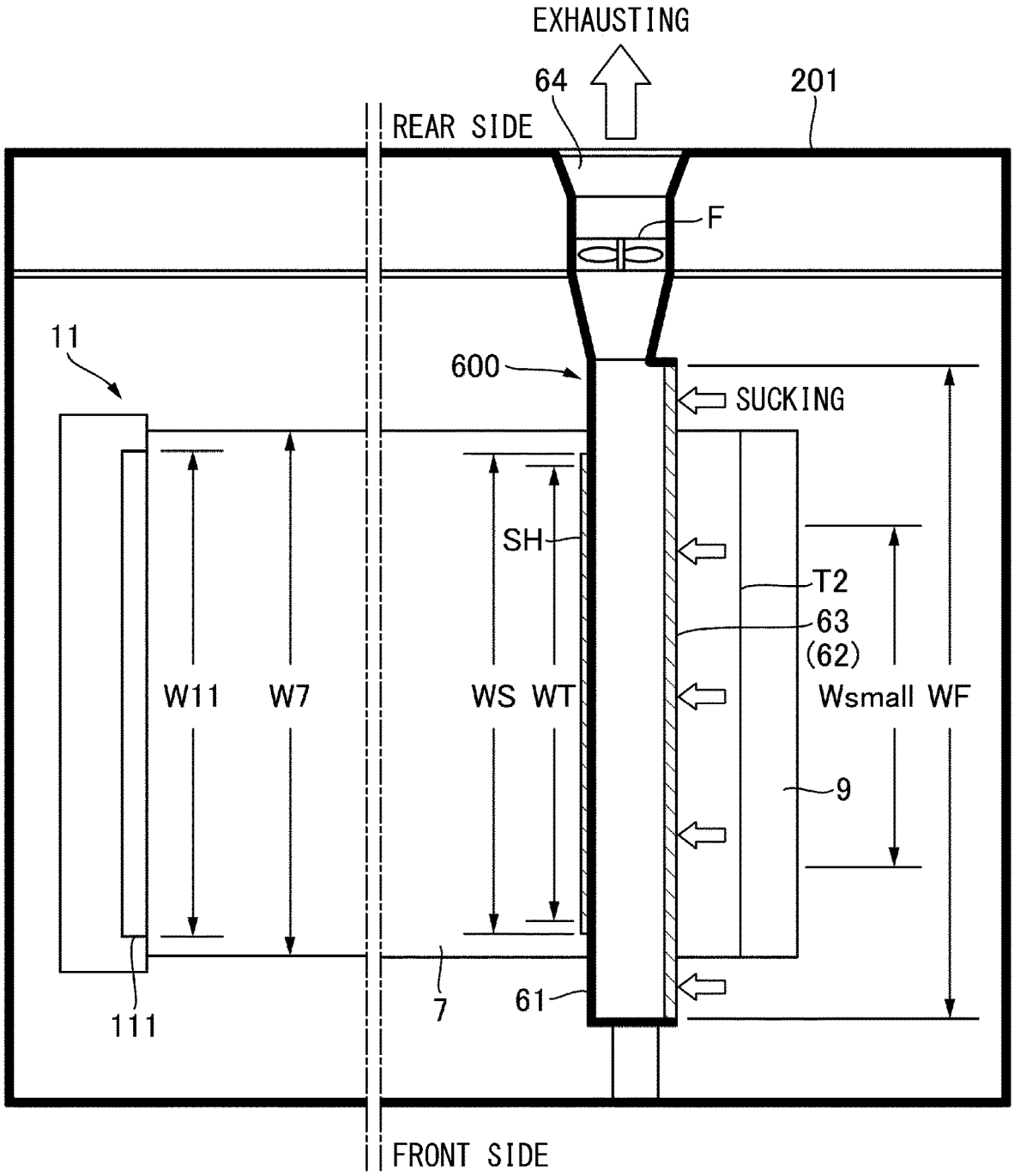

FIG. 9 is a sectional view of a schematic structure of the image forming apparatus along line A-A in FIG. 8.

Figure 10:
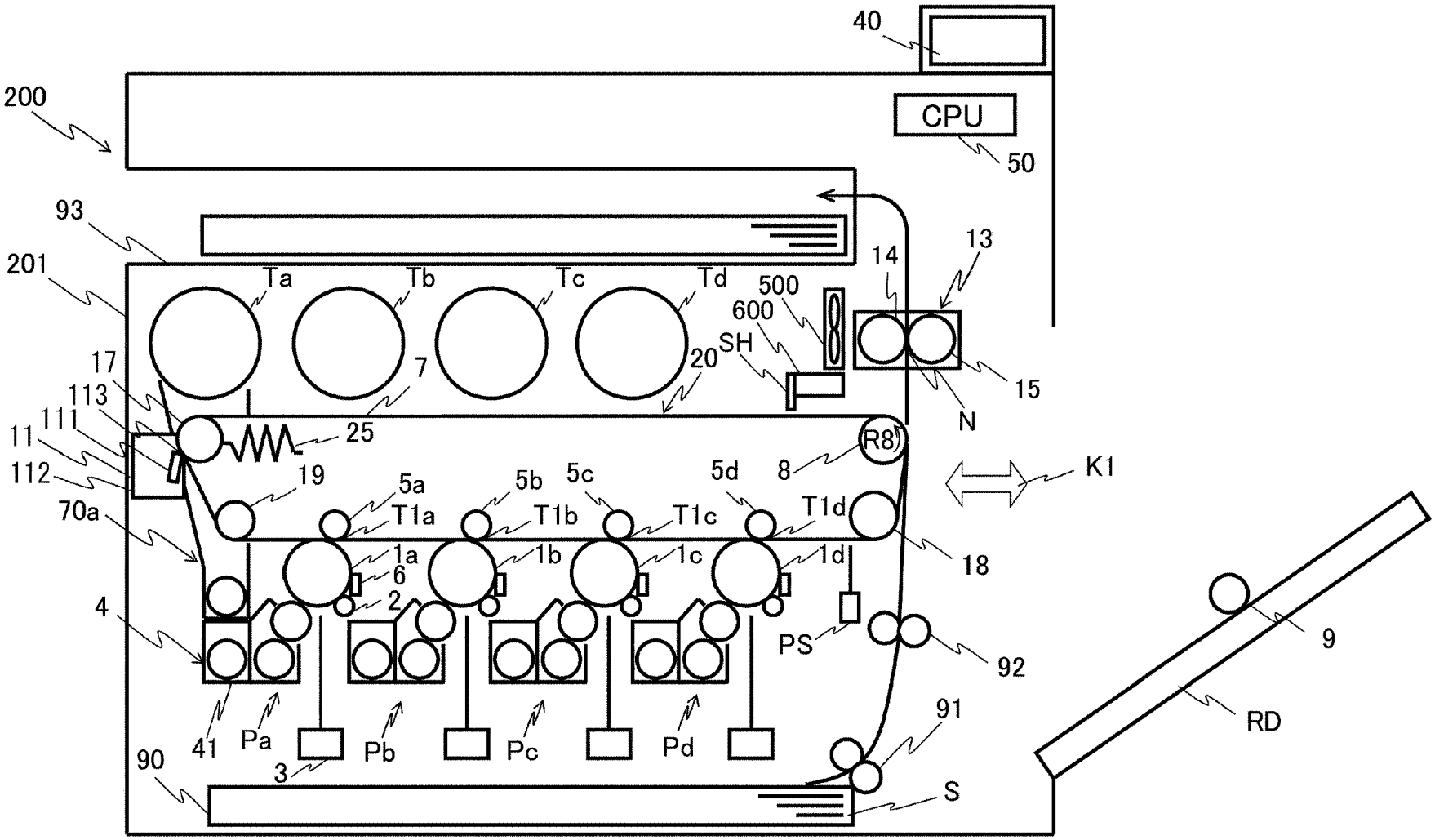

FIG. 10 is a sectional view of a schematic structure showing a structure for attaching to and detaching from the intermediary transfer unit from a main assembly.

Figure 11:
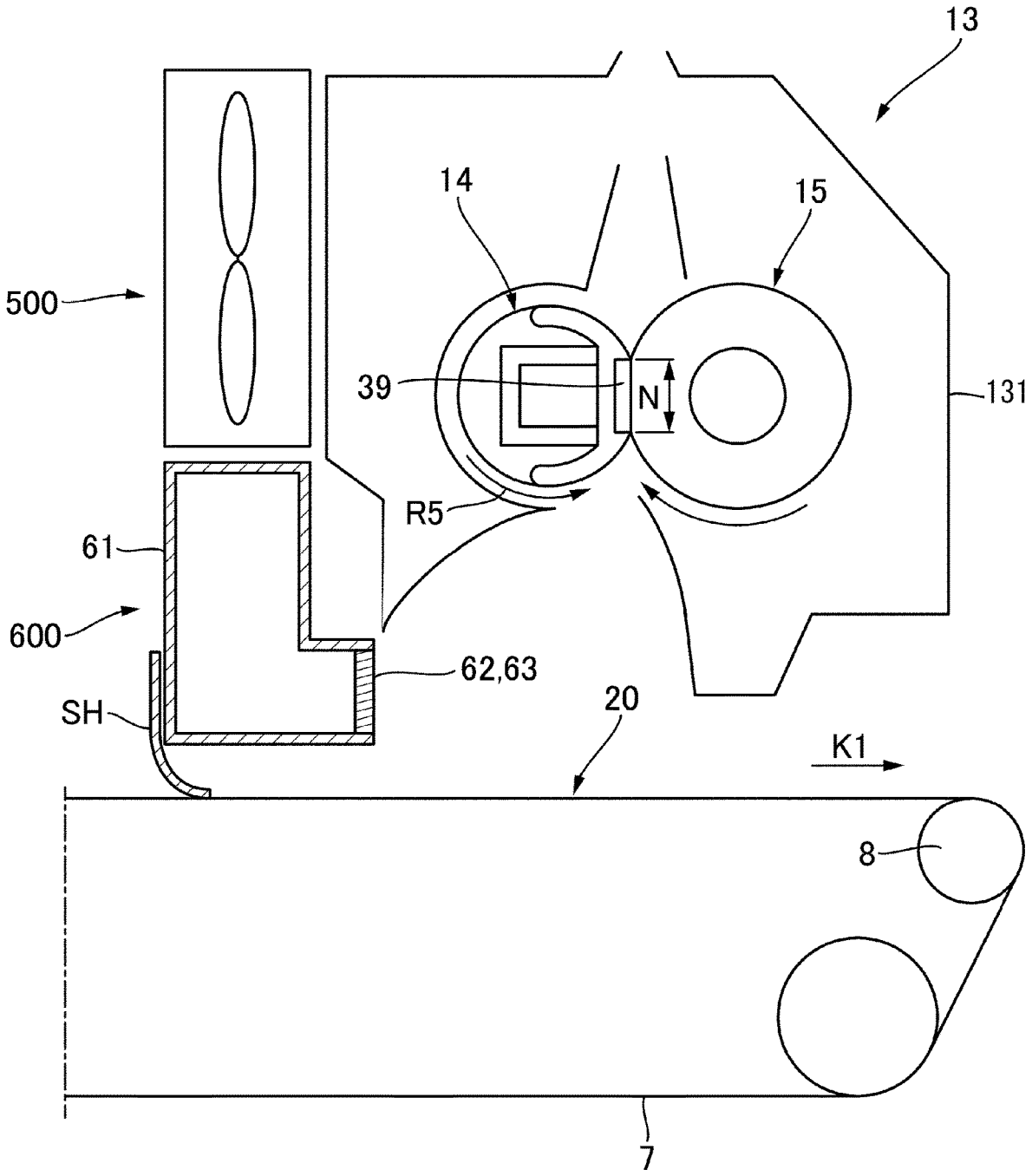

FIG. 11 is an enlarged sectional view of the secondary transfer portion and the peripheral portion of the fixing device in the case that the intermediary transfer unit is detached from the main assembly.

Figure 12:
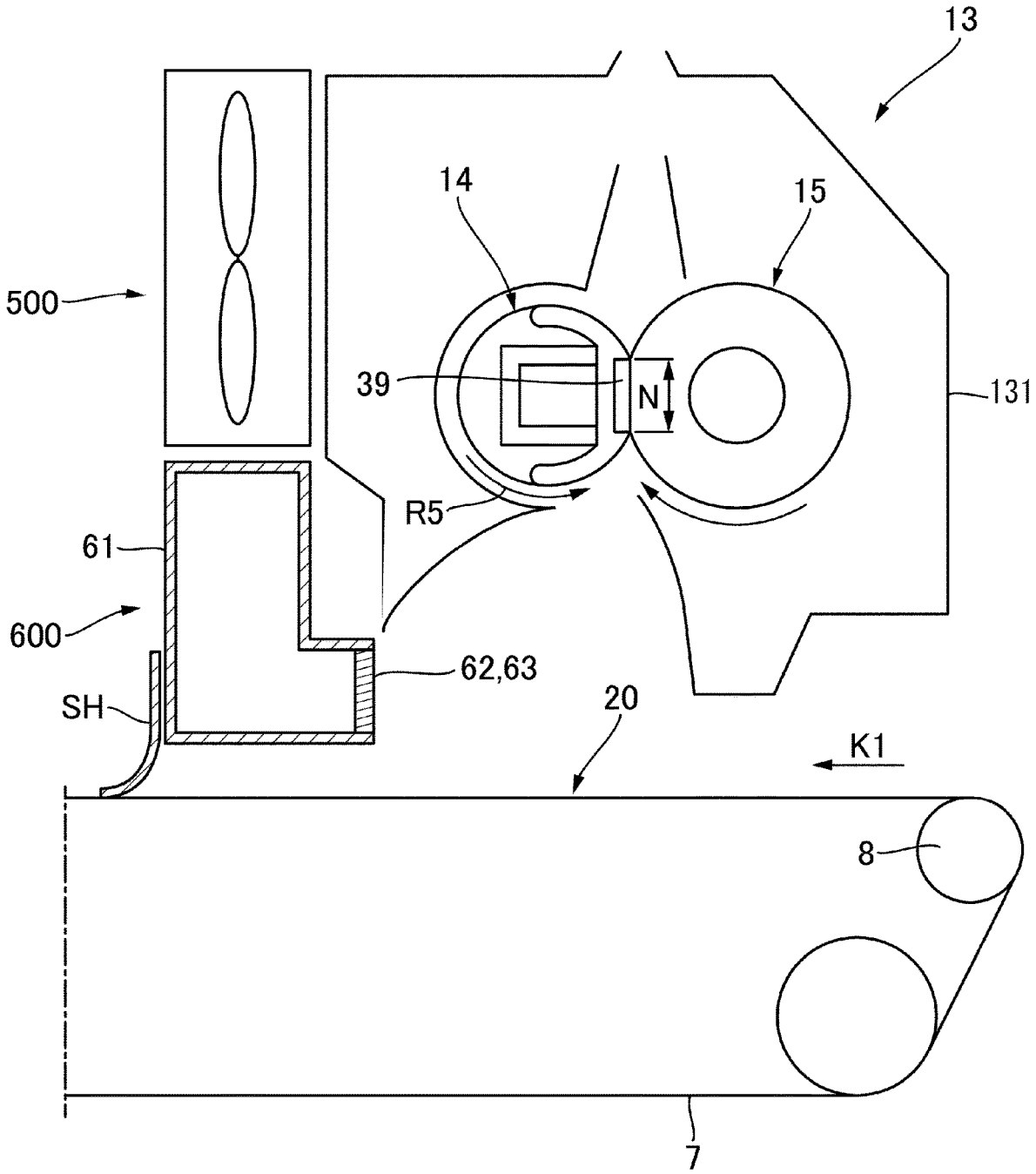

FIG. 12 is an enlarged sectional view of the secondary transfer portion and the peripheral portion of the fixing device in the case that the intermediary transfer unit is attached to the main assembly.

DESCRIPTION OF THE EMBODIMENTS

In the following, an embodiment of the present invention will be described with reference to FIGS. 1-12. First, a schematic structure of an image forming apparatus 200 in the embodiment will be described with reference to FIG. 1.

[Image Forming Apparatus]

The image forming apparatus 200 is a printer of a generally known intermediary transfer tandem system, provided with four image forming portions Pa, Pb, Pc and Pd, and an intermediary transfer unit 20 inside the main assembly. The imaging forming apparatus 200 forms and outputs an image on a recording material S depending on image information read from a document or input from an external device. Incidentally, the recording material S includes special paper such as coated paper, paper with special shape such as envelope and index paper, plastic film for overhead projectors, cloth, and other sheets, in addition to plain paper.

A plurality of image forming portions Pa, Pb, Pc and Pd are image forming units which form yellow, magenta, cyan and black toner images and are provided with photosensitive drums 1*a*, 1*b*, 1*c* and 1*d*, which are image bearing members for electrophotography, respectively. Since a constitution of each image forming portion is basically the same except for the color of toner used for development, the constitution of the yellow image forming portion Pa will be described as an example below.

The image forming portion Pa is provided with a charging roller 2 as a charging device, an exposure device 3, a developing device 4, and a drum cleaning device 6 around a photosensitive drum 1*a*, which is a drum shaped photosensitive member. When an operation of the image forming starts, the photosensitive drum 1*a* as the image bearing member is rotationally driven in a direction of an arrow R1. A surface of the rotating photosensitive drum 1*a* is uniformly charged by the charging roller 2 to a predetermined electrical potential of a predetermined polarity (negative polarity in this embodiment). The surface of the charged photosensitive drum 1*a* is scanned and exposed by the exposure device 3 (laser scanner in this embodiment) according to the image information and an electrostatic latent image is formed on the drum surface.

The electrostatic latent image formed on the photosensitive drum 1*a* is visualized (developed) and becomes a toner image by being supplied with a yellow toner from the developing device 4, which accommodates a developer in a developer container 41. In this embodiment, the developing device 4 attaches toner charged with the same polarity (reverse developing) as that of the photosensitive drum 1 (negative polarity in this embodiment) to an exposed portion (image portion) on the photosensitive drum 1 where an absolute value of the electrical potential is reduced by being exposed after being uniformly charged. In this embodiment, a normal charging polarity of the toner, which is the charging polarity of the toner during development, is negative. Further, in this embodiment, the charging roller 2, the exposure device 3, and the developing device 4 constitute a toner image forming means which forms a toner image on the photosensitive drum 1.

Incidentally, developer containers Ta, Tb, Tc, and Td, which accommodate developer for replenishing, are attached to the main assembly 201 of the image forming apparatus 200, being attachable and detachable. For example, the developer container Ta accommodates a developer containing yellow toner, which is replenished in the developer container 41 via a replenishing device 70*a* at an appropriate time. Further, as the developer, a two-component developer which contains a magnetic carrier and a non-magnetic toner, a one-component developer composed of a magnetic toner, or a liquid developer in which toner particles are dispersed in a carrier liquid may be utilized.

The intermediary transfer unit 20 as a belt unit is provided with an intermediary transfer belt 7, which is an endless belt member, and a plurality of stretching rollers as stretching members in which the intermediary transfer belt 7 is stretched. Specifically, the intermediary transfer belt 7 is wound around a secondary transfer inner roller 8, a steering roller 17, a spacing roller 19, and an upstream guide roller 18, which are the plurality of stretching rollers, and is opposed to the photosensitive drums 1*a* to 1*d* of the image forming portions Pa to Pd on the outer periphery.

Further, primary transfer rollers 5*a*, 5*b*, 5*c* and 5*d* as a plurality of transfer members are arranged on an inner peripheral side of the intermediary transfer belt 7. The primary transfer rollers 5*a* to 5*d* are arranged at positions corresponding to each of the photosensitive drums 1*a* to 1*d* of the image forming portions Pa to Pd, and constitute primary transfer portions T1*a*, T1*b*, T1*c* and T1*d* where the toner image is transferred from the photosensitive drums 1*a* to 1*d* to the intermediary transfer belt 7. Further, the primary transfer rollers 5*a* to 5*d* urge an inner peripheral surface of the intermediary transfer belt 7 toward the photosensitive drums 1*a* to 1*d*, contact the photosensitive drums 1*a* to 1*d* with the intermediary transfer belt 7, and constitute the primary transfer portions (primary transfer nip portions) T1*a* to T1*d*.

The intermediary transfer belt 7 rotates (circulating movement) in a direction (arrow R2) which accompanies the rotation of the photosensitive drums 1*a* to 1*d*(arrow R1), while the secondary transfer inner roller 8 as a secondary transfer roller is rotationally driven in a predetermined direction (arrow R3) by an unshown motor. That is, the secondary transfer inner roller 8 is also a driving roller which rotationally drives the intermediary transfer belt 7.

Further, the secondary transfer inner roller 8 is arranged further downstream of an upstream guide roller 18 with respect to the rotational direction of the intermediary transfer belt 7. The secondary transfer inner roller 8 opposes a secondary transfer outer roller 9 across the intermediary transfer belt 7, and constitutes a secondary transfer portion T2 as a nip portion between a portion of the intermediary transfer belt 7 stretched over the secondary transfer inner roller 8 and the secondary transfer outer roller 9. That is, the secondary transfer outer roller 9 is urged toward the secondary transfer inner roller 8, abuts with the secondary transfer inner roller 8 via the intermediary transfer belt 7 and constitutes the secondary transfer portion (secondary transfer nip portion) T2 where the intermediary transfer belt 7 contacts with the secondary transfer outer roller 9. The secondary transfer inner roller 8 is also a roller for transferring the toner image from the intermediary transfer belt 7 to the recording material S.

The steering roller 17 is arranged downstream of the secondary transfer inner roller 8 and upstream of the spacing roller 19 with respect to the rotational direction of the intermediary transfer belt 7. The steering roller 17 has an alignment function to control a position in a width direction intersecting (substantially perpendicular to in this embodiment) the rotational direction of the intermediary transfer belt 7, as will be described in detail later. Further, the steering roller 17 is also a tension roller which provides tension to the intermediary transfer belt 7.

The upstream guide roller 18 is arranged upstream of the secondary transfer inner roller 8 and downstream of the primary transfer rollers 5*a* to 5*d* (the most downstream of primary transfer roller 5*d*) with respect to the rotational direction of the intermediary transfer belt 7. And it guides the intermediary transfer belt 7 so that the intermediary transfer belt 7 enters the secondary transfer portion T2 from a certain direction. Further, the upstream guide roller 18 and the spacing roller 19 are a pair of stretching rollers arranged upstream and downstream of a portion of the intermediary transfer belt 7 which opposes the plurality of photosensitive drums 1*a* to 1*d* with respect to the rotational direction of the intermediary transfer belt 7. The upstream guide roller 18 is a stretching roller arranged on a downstream side of a portion of a pair of stretching rollers opposing each other. And the upstream guide roller 18 and the spacing roller 19 are able to form a transfer surface where the toner image is transferred from the plurality of photosensitive drums 1*a* to 1*d* to the intermediary transfer belt 7.

The spacing roller 19 is movable and is arranged downstream of the steering roller 17 and upstream of the primary transfer rollers 5*a* to 5*d* (the most upstream primary transfer roller 5*a*) with respect to the rotational direction of the intermediary transfer belt 7. Further, the primary transfer rollers 5*a* to 5*d* and the spacing roller 19 are movable by a spacing mechanism 300 (which will be described below, see FIG. 6, parts (a) to (c)), so it is possible to change a stretching cross section, which is a cross section along the rotational direction of the intermediary transfer belt 7. That is, the spacing mechanism 300 is able to space an outer peripheral surface of the intermediary transfer belt 7 from part or all of the photosensitive drums 1*a* to 1*d* by moving the spacing roller 19 and the primary transfer rollers 5*a* to 5*d*, as will be described in detail below.

In other image forming portions Pb to Pd, magenta, cyan and black toner images are formed on the photosensitive drums 1*b* to 1*d*, respectively, by the same image forming process as in the image forming portion Pa. And the toner images formed on the photosensitive drums 1*a* to 1*d* are primary transferred to the intermediary transfer belt 7 in the primary transfer portions T1*a* to T1*d* by an electrostatic bias (transfer bias) applied to the primary transfer rollers 5*a* to 5*d*. At this time, in a case that a full color image is formed, the toner images borne on each of the photosensitive drums 1*a* to 1*d* are multiply transferred so that they overlap each other. After passing through the primary transfer portions T1*a* to T1*d*, a transfer residual toner and other attached materials on the photosensitive drums 1*a* to 1*d* are removed by the drum cleaning device 6.

The toner image borne on the intermediary transfer belt 7 is secondarily transferred to the recording material S in the secondary transfer portion T2 by applying an electrostatic bias (secondary transfer bias) to the secondary transfer outer roller 9. After passing through the secondary transfer portion T2, the transfer residual toner and other attached materials on the intermediary transfer belt 7 are removed and collected by a belt cleaning device 11.

In this embodiment, the belt cleaning device 11 is arranged downstream of the secondary transfer portion T2 and upstream of the most upstream image forming portion Pa with respect to the rotational direction of the intermediary transfer belt 7. In this embodiment, the belt cleaning device 11 is arranged at a position opposing the steering roller 17 via the intermediary transfer belt 7. The belt cleaning device 11 is composed of a cleaning blade 111 as a cleaning member and a cleaning container 112. The cleaning blade 111 is urged toward the steering roller 17 via the intermediary transfer belt 7 and cleans the surface of the intermediary transfer belt 7 in an abutting portion (cleaning nip portion 113) between the intermediary transfer belt 7 and the cleaning blade 111. That is, the belt cleaning device 11 scrapes off secondary transfer residual toner, paper dust, and other attached materials from the surface of the rotating intermediary transfer belt 7 by the cleaning blade 111 in the cleaning nip portion 113. The attached materials scraped off by the cleaning blade 111 are accommodated in the cleaning container 112.

The toner and other attached materials accommodated in the cleaning container 112 are discharged from the cleaning container 112 by a feeding member (not shown) in the cleaning container 112 and are fed to a collection container (not shown) via a feeding passage (not shown) for collection. In this embodiment, the drum cleaning device 6 has a similar configuration with the belt cleaning device 11 described above.

In parallel with the image forming process, the recording material S accommodated in a feeding cassette 90 is fed one sheet at a time by a feeding roller 91, etc., and is fed to a registration roller pair 92. The registration roller pair 92 corrects oblique movement of the recording material S and feeds the recording material S to the secondary transfer portion T2 in accordance with a progress of the image forming process by the image forming portions Pa, Pb, Pc, and Pd.

The recording material S, to which an unfixed toner image is transferred in the secondary transfer portion T2, is fed to the fixing device 13. The fixing device 13 includes a heating belt 14 as a heating rotatable member which is heated by a heat source such as a ceramic heater, and a pressurization roller 15 as a pressurization rotatable member which presses against the heating belt 14. The fixing device 13 applies heat and pressure to the recording material S while nipping and feeding the recording material S between the heating belt 14 and the pressurization roller 15. Thus, the fixing device 13 melts and fixes toner to the recording material S, and fixes the image to the recording material S. Incidentally, the heating belt 14 is a thin, film-like belt. However, the heating rotatable member may be a belt or a roller other than a film. Further, the pressurization rotatable member may be a belt.

The recording material S which has passed through the fixing unit 13 is discharged to a discharge tray 93 provided on an upper part of the main assembly 201. Further, in a case of duplex printing, the recording material S with a first side (front) and a second side (back) reversed is fed again to the registration roller pair 92 through an unshown reversing feeding passage. And the recording material S, which has passed through the secondary transfer portion T2 and the fixing device 13 and has an image formed on the back side, is discharged to the discharge tray 93.

Incidentally, an operation display portion 40, which serves as a user interface, is provided on an upper surface of the main assembly 201. The operation display portion 40 includes a display portion such as an LCD panel which is able to display a current setting information, etc., and an operation portion such as various buttons which allow an operator, such as a user or a service representative, to input information. The operator is able to set, for example, to switch an output image between a color image and a monochrome image, from the operation display 40.

Further, on the main assembly 201, a controller 50, which provides general control of the operation of the image forming apparatus 200 depending on information input via the operation display unit 40, is mounted. The controller 50 includes a CPU (Central Processing Unit), a ROM (Read Only Memory), and a RAM (Random Access Memory). The CPU controls each portion while reading a program corresponding to a control procedure stored in the ROM. Further, the RAM stores working data and input data, and the CPU performs control by referring to the data stored in the RAM depending on the program described above, etc.

Further, the main assembly 201 includes a patch sensor PS as a density detection means which is capable of detecting a density of a toner image borne on the outer peripheral surface of the intermediary transfer belt 7. The patch sensor PS is arranged so as to oppose the outer peripheral surface of the intermediary transfer belt 7 on downstream side of the photosensitive drum 1*d* of the most downstream image forming portion Pd and on upstream side of the upstream guide roller 18 with respect to the rotational direction of the intermediary transfer belt 7. The patch sensor PS is capable of detecting a density of a toner image on the intermediary transfer belt 7, for example, by including a light emitting portion and a light receiving portion, emitting light from the light emitting portion toward the outer peripheral surface of the intermediary transfer belt 7 and receiving reflected light with the light receiving portion. The controller 50 is capable of executing control for adjusting a density of an output image by using the patch sensor PS. For example, the controller 50 controls to form a patch image as a control image on the outer peripheral surface of the intermediary transfer belt 7 every predetermined number of sheets, and detects a density of the patch image with the patch sensor PS. And depending on the detection result, a toner supply amount to the developing device 4 is adjusted to maintain a proper density of an output image.

Further, in this embodiment, in each of the image forming portions Pa to Pd, the photosensitive drums 1*a* to 1*d*, the charging roller 2 and the drum cleaning device 6 as process means acting on the photosensitive drums, constitute drum units which are integrally attachable to and detachable from the main assembly 201. Further, in each of the image forming portions Pa to Pd, the developing devices 4 constitute developing units which are attachable to and detachable from the main assembly 201 substantially independently. Further, the intermediary transfer belt 7, each of the stretching rollers 8, 17, 18, 19, each of the primary transfer rollers 5*a* to 5*d*, and the belt cleaning device 11 constitute the intermediary transfer unit 20 which is integrally attachable to and detachable from the main assembly 201.

[Intermediary Transfer Unit]

Figure 1:
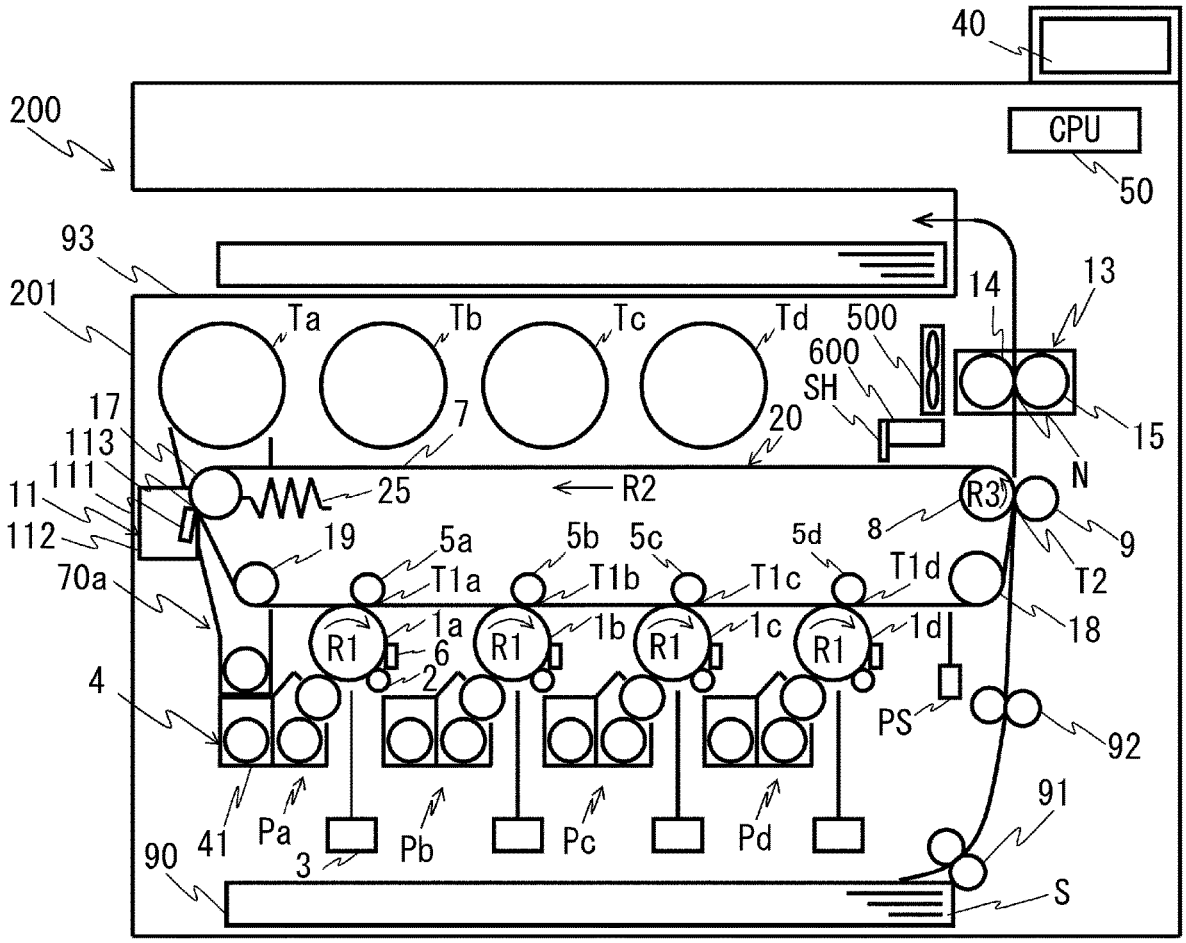
FIG. 1 is a sectional view showing a schematic structure of an image forming apparatus according to an embodiment.

Next, an internal configuration of the intermediary transfer unit 20, which is an example of a belt feeding device, and a configuration for steering the intermediary transfer belt 7 will be described by using part (a) of FIG. 2 through FIG. 4. Here, with respect to the image forming apparatus 200 and its elements, a front side of the drawing sheet of FIG. 1 is a "front" side and a rear side of the drawing sheet is a "rear" side. A direction connecting the front side and the back side is assumed to be substantially parallel to a direction of a rotational axis of the photosensitive drums 1*a* to 1*d*. Further, with respect to the image forming apparatus 200 and its elements, an up-down direction refers to up and down in a direction of gravity (vertical direction), and it does not only mean immediately above and below, respectively, but also include includes above and below a horizontal plane which passes through a certain element or position, respectively.

Part (a) of FIG. 2 is the perspective view of the intermediary transfer unit 20 from diagonally above on the rear side. And part (b) of FIG. 2 is the perspective view of the intermediary transfer unit 20 from diagonally above on the rear side, while the intermediary transfer belt 7 is dismounted. Incidentally, in part (a) of FIG. 2 and part (b) of FIG. 2, the belt cleaning device 11 is not shown for simplicity.

As shown in FIG. 2, parts (a) and (b), the intermediary transfer unit 20 includes a transfer frame 21 as a frame (holding member) of the intermediary transfer unit 20, which is supported by a transfer rail as a guide member as will be described below. Each of the secondary transfer inner roller 8, the upstream guide roller 18, and the spacing roller 19 is held between a side portion of the front side and a side portion of the rear side of the transfer frame 21, and each of both end portions with respect to a direction of the rotational axes is rotatably supported by each of the side portions described above via bearing members.

Here, the direction of the rotational axis of the secondary transfer inner roller 8, the upstream guide roller 18, and the spacing roller 19 is defined as a width direction of the intermediary transfer belt 7 (a direction which is substantially perpendicular to a feeding direction of the intermediary transfer belt 7). Incidentally, the direction of the rotational axis of the secondary transfer inner roller 8, the upstream guide roller 18, and the spacing roller 19 is substantially parallel to the direction of rotational axis of the photosensitive drums 1*a* to 1*d*. Further, as will be described in detail below, a self-alignment mechanism 17U including the steering roller 17 is supported by a steering supporting portion (not shown) provided with the transfer frame 21.

A driving coupling 34 as a driving transmission means is attached to one end portion (end portion on the rear side end in this embodiment) with respect to the direction of the rotational axis of the secondary transfer inner roller 8 which has a function of a driving roller. The driving coupling 34 is connected to an output shaft of a belt driving unit (not shown) provided with the main assembly 201 and transmits a driving force from the belt driving unit to the secondary transfer inner roller 8, while the intermediary transfer unit 20 is mounted on the main assembly 201. The belt driving unit includes a driving source such as a motor and a coupling member which engages the driving coupling 34.

The secondary transfer inner roller 8 includes a surface which is composed of a material with a relatively high friction coefficient against the intermediary transfer belt 7 such as rubber, and feeds the intermediary transfer belt 7 in a direction of an arrow R2 in part (a) of FIG. 2 by transmitting driving force via the driving coupling 34. Incidentally, in this embodiment, the driving coupling 34 is applied as the driving transmission means, however, the present invention is not limited to this form. For example, a driving source provided in the main assembly 201 and a driving roller provided in the intermediary transfer unit 20 may be connected by using a removable gear as a driving transmission means.

FIG. 3 and FIG. 4 are perspective views showing configuration of the self-alignment mechanism 17U in this embodiment. FIG. 3 is a perspective view of the overall self-alignment mechanism 17U from diagonally above on the rear side, and FIG. 4 is a perspective view of a vicinity of an end portion on the rear end of the self-alignment mechanism 17U. In this embodiment, the self-alignment mechanism 17U is constituted including the steering roller 17, as well as a steering bearing 23, a slide guide 24, a tension spring 25 and a swingable plate 26, as will be described below.

In this embodiment, the intermediary transfer unit 20 includes the self-alignment mechanism 17U as a steering mechanism. The self-alignment mechanism 17U is constituted to automatically tilt the steering roller 17, so as to maintain a balance of frictional forces at both end portions with respect to a direction of a rotational axis of the steering roller 17, against the intermediary transfer belt 7 being fed as described above. As a result, the self-alignment mechanism 17U is able to control alignment (steering) of the intermediary transfer belt 7, that is, a position of the intermediary transfer belt 7 with respect to a width direction, by controlling a tilt of the intermediary transfer belt 7 without requiring a sensor or an actuator.

As shown in FIG. 3, the steering roller 17 includes a cylindrical roller body 17*a* and roller shafts 17*b* which protrude outward from both end portions of the roller body 17*a* with respect to the direction of the rotational axis of the steering roller 17. The steering bearings 23 as bearing members are arranged at positions opposing to both end portions of the roller body 17*a* with respect to the direction of the rotational axis, respectively. Each of the roller shafts 17*b* is rotatably supported by each of the steering bearings 23 in a form of being fitted into each of supporting portions (bearing portions) 23*a* provided with the steering bearings 23, respectively, as shown in FIG. 4.

The pair of steering bearings 23 are supported by the swingable plate 26 as a supporting member, while supporting both end portions of the steering roller 17 with respect to the direction of the rotational axis of the steering roller 17. That is, the pair of steering bearings 23 are supported, so as to be slidingly movable, by slide guides 24 as bearing supporting members attached to both end portions with respect to a longitudinal direction of the swingable plate 26 which is substantially parallel to the direction of the rotational axis of the steering roller 17. A tension spring 25 in a compressed state, consisting of a compressed coil spring which is an urging member as an urging means, is provided between the steering bearing 23 and the slide guide 24. The pair of tension springs 25 apply urging forces on the pair of steering bearings 23 at both end portions with respect to a longitudinal direction of the swingable plate 26, respectively.

The swingable plate 26 is consisting of a swingable member which supports the steering roller 17, while a relative alignment of the steering roller 17 against other stretching rollers such as the secondary transfer inner roller 8 is adjustable by swinging (revolving and tilting) the steering roller 17. Incidentally, the alignment of the steering roller 17 against other stretching rollers such as the secondary transfer inner roller 8 is also referred to simply as the alignment of the steering roller 17. Further, the tension spring 25 constitutes a tension applying means which applies tension to the intermediary transfer belt 7 by urging the steering roller 17 against the inner peripheral surface of the intermediary transfer belt 7.

As shown in FIG. 3 and FIG. 4, the slide guide 24 includes an engaging groove (recessed portion) 243 which guides the steering bearing 23 to move in a direction of an arrow K1 in FIG. 4, that is, along an urging direction (pressurizing direction) of the tension spring 25 against the intermediary transfer belt 7. In the engaging groove 243, one end portion of the tension spring 25 abuts with a bearing surface provided with the slide guide 24, and the other end portion of the tension spring 25 abuts with a bearing surface provided with the steering bearing 23. That is, the pair of slide guides 24 constitute guiding portions which guide the pair of steering bearings 23 along the urging direction (pressurizing direction) of the tension spring 25 against the intermediary transfer belt 7, respectively. As a result, the urging force of each tension spring 25 can be effectively transmitted to the corresponding steering bearing 23.

As shown in part (a) of FIG. 2, when the intermediary transfer belt 7 is stretched over the plurality of stretching rollers 8, 17, 18, and 19, the steering bearing 23 moves in a direction of compressing the tension spring 25. Thus, in this state, the steering roller 17 urges against the inner peripheral surface of the intermediary transfer belt 7 by a spring force of the tension spring 25, and tension is generated in the intermediary transfer belt 7. In this way, in this embodiment, the steering roller 17 also serves as a tensioning roller (tension applying roller) which applies appropriate tension to the intermediary transfer belt 7 by the urging force of the tension spring 25.

As shown in FIG. 3, a revolving shaft member 27 as a supporting shaft is fixed to the swingable plate 26 at a center position in its longitudinal direction, in a state that the revolving shaft member 27 is protruding toward the transfer frame 21 side along a tangent plane of an intermediary transfer belt 7 side of the plurality of photosensitive drums 1*a* to 1*d*. Further, the swingable plate 26 has slide guides 24 attached to both end portions of its longitudinal direction, respectively. As shown in part (b) of FIG. 2 and FIG. 4, the revolving shaft member 27 is fitted, so as to be capable of revolving, to the steering supporting portion which is provided with the transfer frame 21. As a result, the swingable plate 26 is supported by the transfer frame 21 in a swingable (capable of revolving and tilting) way. As shown in FIG. 3, the swingable plate 26 is swingable in a swinging direction Ro around a steering axis line J as an axis line of the revolving shaft member 27, while the swingable plate 26 supports the steering roller 17. As a result, the end portions of the swingable plate 26 with respect to its longitudinal direction, is movable in the up-down direction in the figure along a direction of an arrow ST1 in FIG. 4. In this way, the self-alignment mechanism 17U as an alignment adjusting means for adjusting an alignment of the steering roller 17 is constituted as a swingable unit with respect to the transfer frame 21 together with the steering roller 17.

[Spacing Mechanism of Intermediary Transfer Belt]

Next, the spacing mechanism 300 as a second spacing mechanism for spacing the intermediary transfer belt 7 from the photosensitive drums 1*a* to 1*d* will be described by using FIG. 5 and FIG. 6, parts (a) to (c). FIG. 5 is a schematic side view of a spacing slider 30, as will be described below, which constitutes the spacing mechanism 300, when viewed from the front side. FIG. 6, parts (a) to (c) are schematic side views of the spacing mechanism 300, when viewed from the front side, to describe a spacing process by the spacing mechanism 300. Part (a) of FIG. 6 is showing a color mode (hereinafter referred to as a "CL mode"), part (b) of FIG. 6 is showing a monochrome mode (hereinafter referred to as a "BK mode"), and part (c) of FIG. 6 is showing a state of a full spacing mode.

The spacing mechanism 300 as a moving mechanism includes a spacing slider 30 as a sliding member, a spacing cam 31 as a cam member, and a spacing cam shaft 32. The controller 50 controls the spacing mechanism 300 to move the spacing roller 19 and it is possible to deform a stretching section, which is a section along the rotational direction of the intermediary transfer belt 7. Further, it is also possible to move the plurality of primary transfer rollers 5*a* to 5*d* in the spacing mechanism 300.

As described above, each of four primary transfer rollers 5*a* to 5*d* is arranged on the inner peripheral surface of the intermediary transfer belt 7, corresponding to each of the four photosensitive drums 1*a* to 1*d*. In this embodiment, these primary transfer rollers 5*a* to 5*d* and the spacing roller 19, which is arranged upstream from the primary transfer rollers 5*a* to 5*d* with respect to the rotational direction of the intermediary transfer belt 7, are movable relative to the transfer frame 21. In this embodiment, each of the primary transfer rollers 5*a* to 5*d* and the spacing roller 19 are slidingly movable along the up-down direction of FIG. 6, parts (a) to (c), that is, a direction of approaching and leaving the tangent plane of the plurality of photosensitive drums 1*a* to 1*d* on the side of the intermediary transfer belt 7.

The primary transfer rollers 5*a* to 5*d* and the spacing roller 19 are moved by a sliding movement of the spacing slider 30 as a moving member shown in FIG. 5. Each of the spacing sliders 30 is accommodated inside the transfer frame 21, adjacent to the side portion of the front side and the side portion of the rear side of the transfer frame 21 (see part (a) of FIG. 2 and part (b) of FIG. 2) of the intermediary transfer unit 20, respectively. The spacing sliders 30 arranged on the front side and the rear side of the transfer frame 21, respectively, have a similar shape (substantially symmetrical with respect to the center of the width direction of the intermediary transfer belt 7).

The spacing slider 30 includes four cam surfaces 30*a*, 30*b*, 30*c*, and 30*d* corresponding to each of the four primary transfer rollers 5*a* to 5*d*, and one cam surface 30*e* corresponding to the spacing roller 19. The spacing slider 30 is held by the transfer frame 21, so as to be slidingly movable along a left-right direction in the figure, that is, a direction along the tangent plane of the plurality of photosensitive drums 1*a* to 1*d* on the side of the intermediary transfer belt 7. The spacing sliders 30, which are arranged respectively on the front side and the rear side of the transfer frame 21, are constituted to slidingly move in the moving direction described above, synchronously.

Each of the cam surfaces 30*a* to 30*e* of the spacing slider 30 includes an inclined surface 301 which is inclined to a slidingly moving direction of the spacing slider 30 and a flat portion 302 which is substantially parallel to the slidingly moving direction of the spacing slider 30, respectively. Each of the cam surfaces 30*a* to 30*e* is designed so as to be capable of operations of each primary transfer roller 5*a* to 5*d* and the spacing roller 19 at a time of mode switching as will be described below. For example, the cam surface 30*e* corresponding to the spacing roller 19 includes the inclined surface 301 corresponding to a lower position in the figure of the spacing roller 19, and a flat portion 302 corresponding to an upper position in the figure of the spacing roller 19.

As shown in FIG. 6, parts (a), (b) and (c), each of the primary transfer roller 5*a* to 5*d* is rotatably supported at both end portions with respect to a direction of the rotational axis by corresponding primary transfer bearings 29*a* to 29*d*. Each of the primary transfer bearings 29*a* to 29*d* is held by the transfer frame 21 at both end portion sides of each of the primary transfer rollers 5*a* to 5*d* with respect to the direction of rotational axis. Each of the primary transfer bearings 29*a* to 29*d* is held by the transfer frame 21, while being fitted along the up-down direction in the figure, that is, the direction of approaching and leaving the tangent plane of the plurality of photosensitive drums 1*a* to 1*d* on the side of the intermediary transfer belt 7. Further, each of the primary transfer bearings 29*a* to 29*d* is restricted from moving toward the left-right direction in the figure, that is, the direction along the tangent plane of the plurality of photosensitive drums 1*a* to 1*d* on the side of the intermediary transfer belt 7.

Each of the primary transfer bearings 29*a* to 29*d* is provided with abutting portions al to dl which abut with each of the cam surfaces 30*a* to 30*d* of the spacing slider 30, respectively. Further, primary transfer springs SPa to SPd, composed of compression coil springs which are urging members as urging means, are provided between each of the primary transfer bearings 29*a* to 29*d* and the transfer frame 21. Each of the primary transfer springs SPa to SPd urges each of primary transfer bearings 29*a* to 29*d* downward in the figure so as to press each of the cam surfaces 30*a* to 30*d*. When the spacing slider 30 slidingly moves, each of the primary transfer bearings 29*a* to 29*d* moves along the up-down direction in the figure while each of the abutting portions al to dl abuts with each of the cam surfaces 30*a* to 30*d*, thereby each of the primary transfer rollers 5*a* to 5*d* moves along the up-down direction in the figure.

As shown in FIG. 6, parts (a), (b) and (c), the spacing roller 19 is also movable in the same way as each of the primary transfer rollers 5*a* to 5*d*. That is, the spacing rollers 19 are rotatably supported at both end portions with respect to the direction of the rotational axis by spacing roller bearings 29*e*. The spacing roller bearings 29*e* are held by the transfer frame 21 at both end portions of the spacing roller 19 with respect to the direction of rotational axis. The spacing roller bearing 29*e* is held by the transfer frame 21, while being fitted along the up-down direction in the figure, that is, the direction of approaching and leaving the tangent plane of the plurality of photosensitive drums 1*a* to 1*d* on the side of the intermediary transfer belt 7. The spacing roller bearing 29*e* is restricted from moving toward the left-right direction in the figure, that is, the direction along the tangent plane of the plurality of photosensitive drums 1*a* to 1*d* on the side of the intermediary transfer belt 7.

The spacing roller bearing 29*e* is provided with an abutting portion el which abuts with the cam surface 30*e* of the spacing slider 30. Further, a spacing roller spring SPe consisting of a compression coil spring, which is an urging member as an urging means, is provided between the spacing roller bearing 29*e* and the transfer frame 21. The spacing roller spring SPe urges the spacing roller bearing 29*e* downward in the figure so as to press the cam surface 30*e*. When the spacing slider 30 slidingly moves, the spacing roller bearing 29*e* moves along the up-down direction in the figure while the abutting portion el abuts with the cam surface 30*e*, thereby the spacing roller 19 moves along the up-down direction in the figure.

The spacing slider 30 includes a slide urged surface 30*f* (FIG. 5) which engages the spacing cam 31 attached to the spacing cam shaft 32. The spacing slider 30 is urged in the left-right direction in the figure, that is, the direction along the tangent plane of the plurality of photosensitive drums 1*a* to 1*d* on the side of the intermediary transfer belt 7, while the slide urged surface 30*f* is pressed by the spacing cam 31. The spacing cam shaft 32 is held between the side of the front side and the side of the rear side of the transfer frame 21, and each of both end portions of the spacing cam shaft 32 in the direction of the rotational axis is rotatably supported by each of the side portions described above via bearing members.

Further, each of the spacing cams 31 is fixed to each of both end portions of the separation cam shaft 32 in the direction of the rotational axis. A spacing coupling 33 (part (a) of FIG. 2), which is connected to a drive source provided with the main assembly 201 while the intermediary transfer unit 20 is mounted on the main assembly 201, is attached to one end portion of the spacing cam shaft 32 in the direction of the rotational axis (the end portion on the rear end side in this embodiment). The spacing slider 30 is movable in a direction intersecting a moving direction of the primary transfer bearings 29*a* to 29*d* and the spacing roller bearing 29*e*.

In this embodiment, each of the primary transfer rollers 5*a* to 5*d* and the spacing roller 19 are moved by the spacing mechanism 300 provided with the spacing slider 30 and the spacing cam 31, and each of the mode switching shown in FIG. 6, part (a), part (b), and part (c) is performed. Incidentally, the mode switching is performed by controlling a rotation phase of the spacing cam shaft 32 depending on a control signal from the controller 50 (FIG. 1) provided with the image forming apparatus 200. Further, an operation in an order of the CL mode, the BK mode, and the full spacing mode will be described here as an example; however, it may be switched between any modes by following the operation in reverse order.

In the CL mode shown in part (a) of FIG. 6, each of the primary transfer rollers 5*a* to 5*d* and the spacing roller 19 are all held in a lower position in the figure, and the intermediary transfer belt 7 abuts with each of the photosensitive drums 1*a* to 1*d*. In this state, a toner image is formed on each of the photosensitive drums 1*a* to 1*d*, and this toner image is transferred to the recording material S via the intermediary transfer belt 7 to form a full color image on the recording material S.

In a case of switching from the CL mode shown in part (a) of FIG. 6 to the BK mode shown in part (b) of FIG. 6, the spacing cam 31 rotates 90 degrees in a direction of an arrow R4 (clockwise direction) in the figure, and the spacing slider 30 slidingly moves in a right direction in the figure (direction of arrow K2 in part (b) of FIG. 6). In the BK mode, the primary transfer rollers 5*a*, 5*b*, and 5*c* for yellow, magenta, and cyan colors move to an upper position in the figure to be spaced from the inner peripheral surface of the intermediary transfer belt 7, and the spacing roller 19 also moves to the upper position in the figure. At this time, the intermediary transfer belt 7 is stretched between the spacing roller 19 at the upper position in the figure and the primary transfer roller 5*d* for the black color which is still held at the lower position in the figure, and is spaced from the photosensitive drums 1*a*, 1*b*, and 1*c* other than the photosensitive drum 1*d* for the black color. In this state, a toner image is formed on the photosensitive drum 1*d* for the black color, and the toner image is transferred to the recording material S via the intermediary transfer belt 7 to form a black single color image on the recording material S.

In a case of switching from the BK mode shown in part (b) of FIG. 6 to the full spacing mode shown in part (c) of FIG. 6, the spacing cam 31 rotates another 90 degrees in the direction of the arrow R4 (clockwise direction) in the figure, and the spacing slider 30 slidingly moves further in the right direction in the figure (direction of arrow K2 in part (c) of FIG. 6). In the full spacing mode, all of primary transfer rollers 5*a* to 5*d* move to the upper position in the figure to be spaced from the inner surface of the intermediary transfer belt 7, and the spacing roller 19 stays in the upper position in the figure. At this time, the intermediary transfer belt 7 is stretched between the spacing roller 19 and the upstream guide roller 18 (FIG. 1) in the upper position in the figure, and is spaced from all of the photosensitive drums 1*a*-1*d*. The intermediary transfer unit 20 is set to the full spacing mode, when the intermediary transfer belt 7 is being replaced, or when, for example, the image forming apparatus 200 is waiting for a signal to command a start of an image forming operation (printing job).

[Air Blowing Device]

Next, an air blowing device (cooling device) which cools the fixing device 13 by blowing air will be described. FIG. 7 is a perspective view of the air blowing device 500 viewed from the rear side. The air blowing device 500 is arranged adjacent to the fixing device 13, and blows air to a predetermined region of the fixing device 13. Specifically, the air blowing device 500 is used in a case of performing a fixing process (image heating process) to a recording material Ssmall whose width size is smaller than a recording material Smax whose maximum width size is Wmax which is a length in a width direction, among recording materials S which are available in the image forming apparatus 200. This is to prevent excessive temperature rise in a region (hereinafter referred to as a non-contact region or a non-passing portion) of the heating belt 14 which does not contact the recording material S, and to selectively cool this non-contact region by air blowing.

The air blowing device 500 includes cooling fans 501*a* and 501*b*, air blowing ducts 502*a* and 502*b*, and opening portions 503*a* and 503*b*. The cooling fans 501*a* and 501*b* start driving upon receiving a command (signal to start operation) from the controller 50 when temperature detected on a surface of the heating belt 14 by a thermistor (not shown in the figure) rises to a predetermined temperature (200 degrees Celsius in this embodiment). The cooling air from the cooling fans 501*a* and 501*b* is blown through the air ducts 502*a* and 502*b*, respectively, and through the opening portions 503*a* and 503*b*, respectively, to a part of a region in a longitudinal direction (width direction) of the heating belt 14, and in this embodiment, to regions near both end portions (predetermined region). Incidentally, a rotational speed of the cooling fans 501*a* and 501*b* is arbitrarily changeable by the controller 50 in accordance with the thermistor.

[Mechanism of UFP Generation]

In the fixing device 13, it is known that UFP (ultrafine particles) is generated due to a mold release agent contained in the toner during a fixing process of the recording material S. The mechanism of UFP generation will be described below.

The fixing device 13 fixes the toner image by contacting the recording material S with a pair of high temperature rotatable members (heating belt 14, pressurization roller 15). In a case of performing fixing process by using this constitution, a part of the toner may be transferred (attached) to the heating belt 14 during the fixing process. This is called an offset phenomenon, and countermeasures for the offset phenomenon are needed since it may cause image defects.

Therefore, the toner used for the image forming apparatus 200 generally contains wax as a mold release agent. When the toner is heated, the wax inside melts and seeps out. Consequently, when fixing process is applied to the toner image, the surface of the heating belt 14 is covered with the melted wax. The heating belt 14 whose surface is covered with the wax obtains an effect of preventing the toner from attaching to it due to mold release property which the wax has.

Incidentally, in this embodiment, compounds which contain molecular structure of wax are also referred as waxes in addition to pure waxes. For example, compounds, in which resin molecules of the toner are reacted with molecular structures of waxes such as a hydrocarbon chain, are also referred as waxes. Further, substances with mold release property such as silicon oil may also be used as mold release agents in addition to waxes.

When wax melts, a part of it vaporizes (volatilizes). This may be due to variations in sizes of molecular components which are contained in waxes. That is, waxes contain low molecular components which have short chains and low boiling points and high molecular components which have long chains and high boiling points, and the low molecular components which have low boiling points vaporize first. When vaporized (gassed) wax component is cooled in the air, fine particles of several nanometers to several hundred nanometers in size are formed (most of formed fine particles are estimated to be several nanometers to several tens of nanometers in diameter). This means that this fine particle is the UFP described above.

Since the UFP is generated by the mechanism described above, the UFP is generated most from a fixing nip portion N where heat is applied to waxes. Further, since the heating belt 14 reaches the highest temperature at upstream side of the fixing nip portion N because of a rotation of the heating belt 14 and a position of a heater 39 (FIG. 8, etc.), it may be estimated that the generation of the UFP is also greatest at upstream of the fixing nip portion N. Furthermore, since the UFP is also generated from the toner image transferred to the recording material S, it may also be estimated that the UFP is generated from an entire image region of the fixing nip portion N.

[UFP Reduction Constitution and Exhaust Heat Constitution]

Next, a constitution for reducing the UFP will be described. In general, the constitution for reducing the UFP is to collect the UFP generated by using a filter and an air suction which is arranged in the main assembly, and to reduce an amount of the UFP discharged outside the apparatus. Here, the filter is arranged in a vicinity of the image region at upstream side of the fixing nip section N, which is a position where a maximum amount of the UFP is generated.

FIG. 8 is the enlarged sectional view of the secondary transfer portion T2 and the fixing nip portion N and FIG. 9 is a sectional view (A-A section) of an exhaust device 600 and the image forming apparatus 200 in FIG. 8. The exhaust device 600 as a UFP reduction constitution is arranged between the secondary transfer portion T2 and the fixing nip portion N of the fixing device 13 with respect to a feeding direction of the recording material, and exhausts air between the secondary transfer portion T2 and the fixing device 13 to the outside.

The exhaust devise 600 includes a duct 61 whose longitudinal direction is along the width direction, and an exhaust fan F which generates airflow in the duct 61. Further, the duct 61 includes an air inlet port 62, a filter 63, and an exhaust port 64. The air inlet port 62 opens toward a space between the secondary transfer portion T2 and the fixing device 13, and is designed so that its longitudinal direction is along the width direction. The filter 63 is arranged so that air taken in (sucked) from the air inlet port 62 passes through it, and collects (filters) the UFP described above. The exhaust port 64 exhausts air which has passed through the filter 63 to the outside (the outside of the apparatus). Further, a sheet member SH composed of a sheet material which has flexibility is provided with the duct 61, and will be described in detail below.

The exhaust system 600 will be described in detail below. The duct 61 in this embodiment is a hollow body of rectangular sectional area long along the longitudinal direction of the fixing device 13. The air inlet port 62 is designed as an opening portion along the longitudinal direction on one side in the longitudinal direction of the duct 61 (surface on the fixing unit 13 side). That is, the air inlet port 62 extends along the longitudinal direction of the fixing nip portion N. And the filter 63 is arranged along the air inlet opening 62 to cover the air inlet opening 62. That is, the filter 63 is a flat member designed so that its longitudinal direction extends in a direction perpendicular to the feeding direction of the recording material, and is fixed to the air inlet 62.

One end portion of the duct 61 (front end portion) is closed, and the other end portion is open as the exhaust port 64. The exhaust fan F is arranged at a position close to the exhaust port 64 inside the duct 61, and when the exhaust fan F is driven, air inside the duct 61 is exhausted from the exhaust port 64, and air is taken into the duct 61 from the air inlet port 62 which is covered by the filter 63. Further, the duct 61 is arranged on the heating belt 14 side of the fixing unit 13 between the secondary transfer portion T2 and the fixing nip portion N. As described above, a heat source which volatilizes the wax is arranged on the heating belt 14 side, and since it is close to the source of UFP, it is arranged so that it is possible to collect UFP more effectively.

The air inlet 62 is located on the fixing nip portion N side rather than in the middle between the secondary transfer portion T2 and the fixing nip portion N, furthermore, it is located in a vicinity of the fixing nip portion N. That is, the air inlet 62 covered by the filter 63 is located in a vicinity of the upstream side of the fixing nip portion N. Specifically, it is arranged in a vicinity of an entrance of the recording material in a casing 131 which accommodates the heating belt 14 and the pressurization roller 15 of the fixing device 13.

The exhaust device 600 of the constitution described above intakes air containing UFP between the secondary transfer portion T2 and the fixing nip portion N from the inlet port 62 covered with the filter 63 into the duct 61 by driving the exhaust fan F, while filtering air with the filter 63. And, air, in which UFP is filtered by the filter 63, is exhausted from the exhaust port 64 to the outside of the apparatus. As a result, an amount of UFP discharged outside of the apparatus by the exhaust device 600 is reduced.

The air inlet 62 has a certain length in a direction (width direction) perpendicular to the feeding direction of the recording material, as shown in FIG. 9. This constitution makes it possible to reliably collect UFP generated from a wax transferred from the toner image of the recording material S to the heating belt 14 in the longitudinal direction (width direction) of the heating belt 14. In FIG. 9, WF is a longitudinal length of the air inlet 62, and WT is a width of the image forming region (maximum image width) on the recording material. W7 is a width of the intermediary transfer belt 7. WF of the length of the inlet port 62 is set to be greater than WT of the maximum image width. In this embodiment, WF is greater than W7, which is the length of the intermediary transfer belt 7 in the width direction.

[Heat exhaust constitution]

Next, a heat exhaust constitution inside the image forming portions Pa to Pd will be described. In this constitution, an operation of the exhaust device 600 reduces the amount of UFP and also exhausts heat from inside the main assembly 201. Each of the image forming portions Pa to Pd contains toner inside to form a toner image, however, due to a mechanism that toner melts by heat, it is vulnerable to temperature rise inside the main assembly 201. For example, it is known that when temperature inside the main assembly 201 rises and exceeds a melting point of the toner, the toner will fuse and form an aggregate inside the imaging portions Pa to Pd, hampering a proper formation of a toner image and resulting in an image defect.

Furthermore, when temperature of the main assembly 201 rises much higher than the melting point of the toner, the toner may stick inside the image forming portions Pa to Pd, which may affect operations of the image forming portions Pa to Pd by themselves. Thus, it is extremely important to exhaust heat inside the main assembly 201, especially in a vicinity of the image forming portions Pa to Pd, in order to operate the main assembly properly.

Here, heat sources which raise temperature in the vicinity of the image forming portions Pa to Pd include driving sources of the image forming portions Pa to Pd; however, a heat source which contributes greatly is the fixing device 13. The reason is that, as described above, due to a mechanism of providing heat to the recording material S to melt the toner image, most of remaining heat other than that used for melting is diffused to a surrounding area. Thus, it is desirable to arrange an airflow path around the fixing device 13, especially in the vicinity of the fixing nip portion N, to exhaust heat from inside of the main assembly 201 to outside. Furthermore, it is appropriate to arrange the airflow path in an upstream portion of the fixing nip portion N, which is also a border with the image forming portions Pa to Pd. For the reasons described above, in this constitution, the operation of the exhaust device 600 reduces the amount of UFP and also exhausts heat from inside the main assembly 201.

[Sheet Member]

Next, a sheet member SH as a shielding member provided with the duct 61 will be described. As shown in FIG. 8 and FIG. 9, the sheet member SH is arranged to oppose the surface of the intermediary transfer belt 7 between the secondary transfer portion T2 and the cleaning blade 111 as the cleaning member via a predetermined gap H1. Further, the sheet member SH is arranged so that its longitudinal direction is along the width direction intersecting the rotational direction of the intermediary transfer belt 7. And the sheet member SH blocks air flowing downstream in the rotational direction of the intermediary transfer belt from between the secondary transfer portion T2 and the fixing device 13. The sheet member SH is a plate-like member and is fixed to the exhaust device 600.

In this embodiment, since the fixing device 13 is arranged above the secondary transfer portion T2, the sheet member SH is also arranged above the intermediary transfer belt 7 so as to extend in the width direction which is perpendicular to the feeding direction R2 of the intermediary transfer belt 7. Further, the exhaust device 600, which is arranged adjacent to the fixing device 13, is also positioned above the intermediary transfer belt 7, and the sheet member SH is provided by adhering to the duct 61 of the exhaust device 600. Further, the sheet member SH is composed of the sheet material which has flexibility, and in this embodiment, it is composed of a urethane sheet material whose thickness is 100 micrometers.

Further, the sheet member SH and the intermediary transfer belt 7 are spaced by a predetermined gap H1, and in this embodiment, the predetermined gap H1 is less than 5 mm (H1 <5 mm). The reason for providing a slight gap between the sheet member SH and the intermediary transfer belt 7 in this way is as follows. The reason is, the secondary transfer residual toner, etc. is attached to the surface of the intermediary transfer belt 7 during image forming operations as described above, and the belt cleaning device 11 to scrape off the attached materials is provided on a downstream side of the sheet member SH. That is, the reason is to prevent the secondary transfer residual toner from attaching to the sheet member SH by contacting.

Further, the sheet member SH is arranged at a position where the distance L1 from the secondary transfer portion T2 with respect to the rotational direction of the intermediary transfer belt 7 is one third or less of a circumferential length of the intermediary transfer belt. That is, the sheet member SH is arranged at a position closer to the secondary transfer portion T2 than the belt cleaning device 11.

Furthermore, the sheet member SH is longer in the width direction than a maximum width of the toner image formed by the image forming portions Pa to Pd, and is arranged so that it overlaps an entire region in the width direction of the maximum width of the toner image which is transferred to the intermediary transfer belt with respect to the rotational direction of the intermediary transfer belt 7. That is, as shown in FIG. 9, a width WS of the sheet member SH is constituted to be greater than a width WT of the toner image of the maximum width (maximum image width), and a relationship WS>WT is established. Further, the sheet member SH is arranged so that the maximum image width WT is placed within a range of the width WS. In this embodiment, since the toner image is transferred with a center standard so that a center of the toner image in the width direction is located at the center of the intermediary transfer belt 7 in the width direction, the sheet member SH is also arranged so that its center position in the width direction is located at the center of the intermediary transfer belt 7 in the width direction. And the relationship WS>WT is made to be established. Further, a width W11 of the cleaning blade 111 is also constituted so that the relationship W11>WT is made to be established due to a constitution of scraping off the secondary transfer residual toner.

A function of the sheet member SH is to suppress air between the secondary transfer portion T2 and the fixing nip portion N of the fixing device 13 (pre-fixing space) from reaching the belt cleaning device 11. When the recording material S passes through the fixing nip portion N, a moisture of the recording material evaporates. Further, as described above, the air blowing device 500 blows cooling air to the heating belt 14 of the fixing device 13, and the cooling air also reaches the recording material S while the recording material S is passing through the fixing nip portion N. In a case that an environment in which the image forming apparatus 200 is installed is humid, the recording material S absorbs moisture, and the moisture in the recording material S is evaporated by the cooling air. And the moisture evaporated as the recording material S is heated in the fixing nip portion N and the moisture evaporated by the cooling air may remain in the pre-fixing space. And accompanied by the feeding operation of the intermediary transfer belt 7 in the direction of R2, an airflow from the pre-fixing space to the belt cleaning device 11 is generated, and the evaporated moisture may reach the belt cleaning device 11. As described above, when the moisture reaches the abutting portion (cleaning nip portion) between the cleaning blade 111 and the intermediary transfer belt 7, the moisture accumulates on the surface of the intermediary transfer belt 7 in the non-passing portion where the recording material has not passed. Then, the frictional resistance may increase in the cleaning nip portion.

In this embodiment, by providing the sheet member SH as described above, it is possible to make the pre-fixing space a substantially closed space by the sheet member SH, the fixing device 13, the intermediary transfer unit 20, the secondary transfer outer roller 9, a right door RD (FIG. 10) including an outer cover and a feeding passage, and the exhaust device 600. This makes it possible to keep the moisture containing air described above inside the pre-fixing space. In addition, since the exhaust device 600 is arranged in the pre-fixing space, it is possible to efficiently exhaust moisture, heat, and furthermore UFP to the outside of the main assembly 201.

Here, the sheet member SH suppresses moisture from reaching the belt cleaning device 11. Effects of moisture reaching the belt cleaning device 11 will be described below. As described above, the belt cleaning device 11 scrapes off the attached materials from the intermediary transfer belt 7 by the cleaning blade 111. The attached materials, which have been scraped off, attach to the cleaning nip portion 113, and when additional attached materials are scraped off, a part of them is replaced, dropped, and accommodated in the cleaning container 112. That is, the attached materials basically continue to remain in the cleaning nip portion 113. Thus, when the moisture containing air described above reaches the belt cleaning device 11, it mixes with the attached materials in the cleaning nip portion 113 and becomes a viscous mixture.

The mixture becomes a resistance for the intermediary transfer belt 7 to be fed. Since the intermediary transfer belt 7 is mainly composed of, for example, synthetic resin with a thickness of 100 micrometer or less, fatigue deformation (permanent elongation) may occur in the intermediary transfer belt 7 in a case that the resistance is continuously applied by the cleaning blade 111 and the mixture. In a case that the intermediary transfer belt 7 is stretched uniformly due to fatigue deformation in an entire region of width W7 or in a region of the maximum image width WT, an image quality transferred to the recording material S is not affected; however, in a case that it is stretched partially, an image quality which is transferred to the recording material S is affected. This principle will be described below.

When the recording material S is passed through the secondary transfer portion T2, as described above, paper dust is attached to the surface of the intermediary transfer belt 7 if the recording material S is paper, in addition to the secondary transfer residual toner in the secondary transfer portion T2. It is generally known that paper dust is mainly composed of chips generated during cutting, peeled paper fibers, and fillers such as clay, talc, titanium dioxide, barium sulfate, and calcium carbonate. The secondary transfer residual toner and paper dust are eventually scraped off by the cleaning blade 111 of the belt cleaning device 11. And, as described above, when the secondary transfer residual toner and paper dust continue to be supplied, the attached materials are replaced at the cleaning nip portion 113 and the cleaning nip portion 113 is lubricated.

For example, when the recording material Ssmall whose width is Wsmall continuously passes through the secondary transfer portion T2, the attached materials at the cleaning nip portion 113 are replaced in a region of Wsmall shown in FIG. 9 (region in which recording material Ssmall passes through) by the secondary transfer residual toner and the paper dust. However, in a region outside of Wsmall (non-passing portion), the secondary transfer residual toner and paper dust are not supplied, so the attached materials at the cleaning nip portion 113 are not replaced. That is, in the region outside of Wsmall, a moisture containing mixture continues to remain, and fatigue deformation (permanent elongation) tends to occur in the intermediary transfer belt 7 due to an increase in frictional resistance. And in a case that fatigue deformation occurs in this region, a region where a stretch occurs in the intermediary transfer belt 7 (the region outside of Wsmall and inside of the end portions of the cleaning blade 111) and a region where a stretch does not occur (region indicated as Wsmall) are formed. As a result, the stretch of the intermediary transfer belt 7 occurs in an outer peripheral direction with irregular concavity and convexity, and a primary transfer efficiency is lower (image is lighter) than a normal state in the concave portion, while the primary transfer efficiency is higher (image is darker) than the normal state in the convex portion.

In a case that these conditions occur, the image quality is not affected as long as the recording material Ssmall whose width is Wsmall continues to pass through as it is. However, when the recording material whose width is wider than Wsmall, for example, the recording material Smax whose width is maximum Wmax, passes through, the deterioration of the transfer image quality becomes apparent outside of Wsmall (in the non-sheet passing portion of the recording material Ssmall).

That is, fatigue deformation (permanent elongation) of the intermediary transfer belt 7 is a phenomenon which occurs when a moisture absorbed in the recording material S reaches the belt cleaning device 11. Thus, in this embodiment, by shielding the moisture absorbed in the sheet member SH, it is possible to suppress the deterioration of the transfer image quality due to such fatigue deformation of the intermediary transfer belt 7.

Further, in this embodiment, the relationship WS>WT is made to be established, so that WS which is the width of the sheet member SH is larger than WT which is the maximum image width. The reason for this is to suppress an effect of the transfer image quality on the recording material S by making a region of fatigue deformation (permanent elongation) of the intermediary transfer belt 7 at least outside the maximum image width WT, as described above.

Further, as described above, since the moisture containing air remains in the pre-fixing space, the intermediary transfer belt 7 on which attached moisture remains may be fed to the belt cleaning device 11. For this reason, it is also required to reduce an area of the intermediary transfer belt 7 which is exposed in the pre-fixing space (a portion shown as L1 in FIG. 8). Therefore, in this embodiment, a belt length L1 which is from the secondary transfer portion T2 of the intermediary transfer belt 7 to the sheet member SH is constituted to be one third or less of the circumference length L7 of the intermediary transfer belt 7. As described above, according to this embodiment, it is possible to suppress fatigue deformation of the intermediary transfer belt 7 and a resulting deterioration of the transfer image quality by shielding the moisture absorbed in the sheet member SH.

[Attaching and Detaching of Intermediary Transfer Unit]

In this embodiment, the sheet member SH is composed of the sheet material which has flexibility, and this reason will be described by using FIG. 10 through FIG. 12. The intermediary transfer unit 20 is constituted to be attachable to and detachable from the main assembly 201 during replacing the intermediary transfer belt 7, etc. FIG. 10 is the schematic sectional view of the image forming apparatus 200 showing a state that the intermediary transfer unit 20 is attached to and detached from the main assembly 201.

The intermediary transfer unit 20 is attachable to and detachable from the main assembly 201 in a state that it is held in the full spacing mode by a spacing mechanism 35. In this embodiment, the intermediary transfer unit 20 is exposed when an operator (replacement operator) opens the right door RD, which is an opening and closing cover provided on a right side of the main assembly 201 as viewed from the front side. Then, the intermediary transfer unit 20 is attachable to and detachable from the main assembly 201 when the operator moves the intermediary transfer unit 20 in the left-right direction in the figure, that is, in the direction along the tangent plane of the plurality of photosensitive drums 1*a* to 1*d* on the side of the intermediary transfer belt 7, which is shown as an arrow K1 in FIG. 10. Incidentally, it is also possible to constitute the apparatus so that the intermediary transfer unit 20 is attachable to and detachable from the main assembly 201 by moving the intermediary transfer unit 20 in the front-back direction as shown in FIG. 10. However, in this embodiment, the direction of attaching and detaching is as described above, from a viewpoint that in such a case, a positioning accuracy of the intermediary transfer unit 20 with respect to the image forming portions Pa to Pd is likely to be reduced, and from a viewpoint that a constitution is likely to be complicated because a casing is required to cover the intermediary transfer unit 20.

Next, referring to FIG. 2, parts (a) and (b), FIG. 8, FIG. 10, and FIG. 12, the operation of the intermediary transfer unit 20 of attaching to and detaching from the main assembly 201 will be further described. Transfer rails (not shown) as guide members which enable the intermediary transfer unit 20 to be attachable and detachable are arranged on an inner surface of the front side and an inner surface of the rear side of the main assembly 201. These transfer rails are constituted so that a first positioning portion 211 and a second positioning portion 212 provided on the transfer frame 21 are movably fitted to them, respectively. The intermediary transfer unit 20 is attachable to and detachable from the main assembly 201 when the intermediary transfer unit 20 is moved to a right direction in the figure along the arrow K1 direction in FIG. 10 in a state that the intermediary transfer unit 20 is in the full spacing mode.

At this time, as shown in FIG. 11, the intermediary transfer unit 20 rises upward by an amount of movement H2 to prevent contact with the photosensitive drums 1*a* to 1*d* and the patch sensor PS. In this case, the intermediary transfer unit 20 abuts with the sheet member SH, and the sheet member SH deforms elastically and flexes as shown in FIG. 11. As described above, the sheet member SH is provided with the gap H1 of less than 5 mm between the sheet member SH and the intermediary transfer belt however, the amount of movement H2 (elevation amount) is constituted to be greater than the predetermined gap H1. That is, the intermediary transfer unit 20 is attachable to and detachable from the main assembly 201, and moves more than the predetermined gap in a direction toward the sheet member SH during the attaching and detaching operation. This is to obtain the aforementioned effect of shielding the air of the sheet member SH and to separate the intermediate transfer unit 20 from the units in close proximity as described above in order to suppress damage to the intermediate transfer belt 7 due to the attachment and detachment of the intermediate transfer unit 20.

An attaching procedure of the intermediary transfer unit 20 on the main assembly 201 is a reverse order of the detaching procedure described above, in which the sheet member SH deforms elastically and flexes as shown in FIG. 12. Once the attachment of the intermediary transfer unit 20 to the main assembly 201 has been completed, the sheet member SH returns to a state shown in FIG. 8 again. Thus, in this embodiment, the sheet member SH is composed of a member which has flexibility, so it is capable of deforming elastically during the attaching and detaching operation of the intermediary transfer unit 20. As a result, it is possible to prevent from damaging the sheet member SH or the intermediary transfer unit 20 by the attaching and detaching operation of the intermediary transfer unit 20.

Incidentally, the sheet member SH does not have to be a member which has flexibility, in a case that it is constituted not to contact with the intermediary transfer unit 20 during the attaching and detaching operation of the intermediary transfer unit 20.

[Other embodiment]

The image forming apparatus of the present invention may be applied to a copying machine, a fax machine, a multi-function machine, etc., in addition to a printer. Further, the image forming apparatus may also be a monochrome image forming apparatus with one image forming portion, other than the constitution with the plurality of image forming portions as described above.

According to the present invention, it is possible to suppress a deterioration of a transfer image quality.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-000703 filed on Jan. 6, 2021, which is hereby incorporated by reference herein in its entirety.

What is claimed is:

1. An image forming apparatus comprising:

an image forming portion configured to form a toner image;

a transfer belt rotatably provided and onto which the toner image is transferred;

a secondary transfer portion configured to transfer the toner image onto a recording material from said transfer belt;

a cleaning member contacting a surface of said transfer belt and configured to clean the surface of said transfer belt;

a fixing device provided above said secondary transfer portion in a vertical direction and configured to fix the toner transferred onto the recording material on the recording material at a fixing nip portion;

an exhausting device provided above said transfer belt to oppose said transfer belt and having an opening portion that opens toward a space between said secondary transfer portion and said fixing device to suck air upstream of the fixing nip portion with respect to a conveyance direction of the recording material, and a duct portion configured to exhaust the air sucked from said opening portion; and a sheet member provided on said exhausting device so as to project toward said transfer belt from said exhausting device, said sheet member being opposed to said transfer belt with a predetermined space to the surface of said transfer belt and being disposed downstream of said transfer portion and upstream of said cleaning member with respect to a rotational direction of said transfer belt, and configured to prevent air flow between said exhausting device and said transfer belt from flowing downstream with respect to the rotational direction of said transfer belt.

2. An image forming apparatus according to claim 1, wherein said sheet member is disposed at a position so that a distance to said secondary transfer portion is equal to or shorter than a circumferential length of said transfer belt with respect to the rotational direction of said transfer belt.

3. An image forming apparatus according to claim 1, wherein said sheet member is disposed so that a longitudinal direction thereof is along a widthwise direction perpendicular to the rotational direction of said transfer belt, a length thereof in the widthwise direction is longer than a maximum width of the toner image formed by said image forming portion and shorter than a width of said transfer belt, and disposed so as to overlap with a whole region of the maximum width of the toner image transferred onto said transfer belt.

4. An image forming apparatus according to claim 1, wherein the predetermined space has a height shorter than 5 mm.

5. An image forming apparatus according to claim 1, wherein said sheet member has flexibility.

6. An image forming apparatus according to claim 1, further comprising a belt unit that includes said transfer belt and a plurality of stretching rollers stretching said transfer belt, said belt unit being attachable to and detachable from a main assembly of said image forming apparatus, and said sheet member contacting said transfer belt in an attaching and detaching operation.

7. An image forming apparatus according to claim 1, wherein said duct portion includes a filter through which the air sucked from said opening portion passes and an exhaustion port configured to exhaust the air passed through said filter to an outside.

8. An image forming apparatus according to claim 1, wherein said sheet member is provided downstream of said opening portion with respect to a rotational direction of said transfer belt.

* * * * *